US010612883B2

(12) United States Patent
Hanson

(10) Patent No.: US 10,612,883 B2
(45) Date of Patent: Apr. 7, 2020

(54) ROTOR SUPPORT SYSTEM AND METHOD FOR ARCHERY BOWS

(71) Applicant: CAMX Outdoors LLC, West Henrietta, NY (US)

(72) Inventor: Jeffrey D. Hanson, Pittsford, NY (US)

(73) Assignee: TOG-IP LLC, Wilmington, DE (US)

( * ) Notice: Subject to any disclaimer, the term of this patent is extended or adjusted under 35 U.S.C. 154(b) by 0 days.

(21) Appl. No.: 16/169,519

(22) Filed: Oct. 24, 2018

(65) Prior Publication Data

US 2019/0120587 A1 Apr. 25, 2019

Related U.S. Application Data

(60) Provisional application No. 62/576,911, filed on Oct. 25, 2017.

(51) Int. Cl.

| | |
|---|---|
| ***F41B 5/10*** | (2006.01) |
| ***F41B 5/12*** | (2006.01) |
| *F41B 5/14* | (2006.01) |

(52) U.S. Cl.

CPC ..... *F41B 5/105* (2013.01); *F41B 5/10* (2013.01); *F41B 5/123* (2013.01); *F41B 5/12* (2013.01); *F41B 5/1403* (2013.01)

(58) Field of Classification Search

CPC ..... F41B 5/10; F41B 5/105; F41B 5/123
See application file for complete search history.

(56) References Cited

U.S. PATENT DOCUMENTS 4,370,972 A * 2/1983 Stewart ..... F41B 5/10 124/25.6
4,724,820 A * 2/1988 Chattin ..... F41B 5/10 124/25.6
4,879,987 A * 11/1989 Nishioka ..... F41B 5/123 124/25
4,976,250 A * 12/1990 Jeffrey ..... F41B 5/10 124/25
5,211,155 A * 5/1993 Zamojski ..... F41B 5/10 124/25.6
5,495,843 A * 3/1996 Larson ..... F41B 5/10 124/25.6
7,823,572 B2 11/2010 Anderson
9,297,604 B1 3/2016 Sidebottom et al.
9,618,294 B2 4/2017 McPherson
(Continued)

OTHER PUBLICATIONS

"Horton EXP Crossbow"; on or before Oct. 4, 2017; retrieved from the Internet <https://www.google.com/search?q=horton+exp&rlz=1C1CHBF_enUS766US766&source=lnms&tbm=isch&sa=X&ved=0ahUKEwi4pti_IOnWAhUC0YMKHUF9Ac8Q_AUICygC&biw=1902&bih=860#imgrc=p9CMnJHJbQfWgM:&spf=1507902139434>; (4 pages).
(Continued)

*Primary Examiner* — John A Ricci
(74) *Attorney, Agent, or Firm* — Barclay Damon LLP

(57) ABSTRACT

A rotor support system and a related method are disclosed herein. The rotor support system, in an embodiment, includes a limb coupler and a rotor coupler. The limb coupler is configured to be moveably coupled to a crossbow limb of an archery crossbow so as to enable a first movement of the limb coupler relative to the crossbow limb. The rotor coupler is configured to be moveably coupled to a rotor of the archery crossbow so as to enable a second movement of the rotor relative to the rotor coupler. The limb coupler and the rotor coupler are operably coupled.

29 Claims, 17 Drawing Sheets

(56) References Cited

U.S. PATENT DOCUMENTS

| | | | |
|---|---|---|---|
| 2006/0144380 | A1 | 7/2006 | Kempf |
| 2015/0233664 | A1 | 8/2015 | McPherson |
| 2017/0003095 | A1 | 1/2017 | Trpkovski |
| 2017/0108307 | A1 | 4/2017 | Yehle |

OTHER PUBLICATIONS

"Tenpoint Eclipse Crossbow"; on or before Oct. 4, 2017; retrieved from the Internet <http://wwwcdn.deeranddeerhunting.com/wp-content/uploads/TENPOINT-Eclipse-crossbow.jpg>; (2 pages).

* cited by examiner

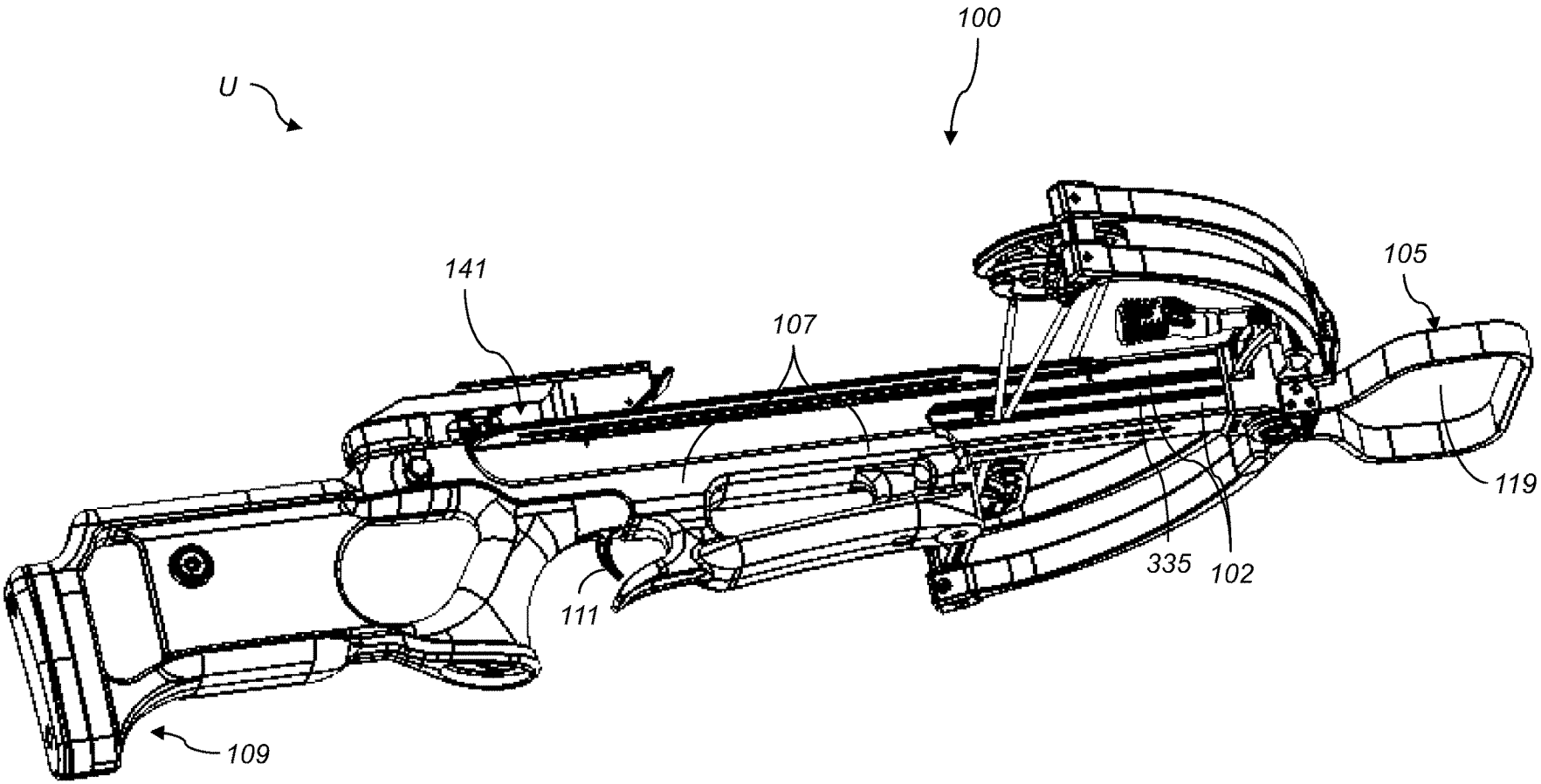
FIG. 1A1

ROTOR SUPPORT SYSTEM AND METHOD FOR ARCHERY BOWS

CROSS-REFERENCE TO RELATED APPLICATION

This application is a non-provisional of, and claims the benefit and priority of, U.S. Provisional Patent Application No. 62/576,911 filed on Oct. 25, 2017. The entire contents of such application are hereby incorporated herein by reference.

BACKGROUND

Archery bows have a long history of use for both hunting and sport. Some bows, including compound bows and crossbows, include cams that are mounted at the opposite ends of the bow. The cams are usually mounted in a symmetric fashion, and may include two stacked pulley or engagement sections, each with grooves, for receiving bowstrings or power cables. In operation, the cams work in conjunction with the bowstring and the power cable in the following manner. When the bow is cocked, the bowstring unwinds from the cams as they rotate. Simultaneous with the drawing of the bowstring during cocking of the bow, segments of the power cable are taken up by the cams as they rotate. The power cable thereby exerts tension on the limbs which then bend inward, storing energy. When the bow is fired, the cams rotate and release the tension on both the bowstring and power cable (and the limb) to propel the arrow forward.

One issue with conventional crossbow designs is that the cams are exposed to potential damage during transport, storage and use of the crossbow. This is because the cams are mounted on the outside profile of the crossbow. Consequently, part (e.g., one-half or more) of the cams protrude beyond the outer surfaces of the limbs. For example, a cam with its axle mounted directly to the limb necessarily extends outward beyond the limb. This is because the radius of the cam is typically larger than the size of the limb end so that the cam can take up and release a sufficient amount of the power cable. When the crossbow is placed on the ground or floor, or in a box or container, or is unintentionally bumped into a tree, person or other object during transport, the axles of the cams may be bent or loosened, the internal bearings of the cams may be deformed or misaligned, the cam grooves may be damaged, or the bowstring or power cable may be damaged.

In addition, the conventional crossbow designs have a relatively wide profile. This is caused, in part, by the protrusion of the cams beyond the outer surfaces of the limbs. This wide profile can make it difficult to use, store and transport crossbows.

Another drawback with conventional archery bow designs is that, upon firing of the bow, the limbs can undergo considerable oscillation. Such oscillations may lead to inaccurate shooting and potential torsional stress on the limbs, the cams, the bearings, and other mechanical components. The oscillation can be due to the torque on the limbs during the firing process, because of the large amount of force that is released upon rotation of the cams.

A further problem with conventional crossbow designs is that cam placement can limit the power stroke of the crossbow. For example, the distance between the trigger and the cams can determine the power of the stroke upon shooting of the crossbow. The crossbow cams are typically mounted at the limb ends, which are typically positioned at the rear ends of the limb, closer to the trigger.

Attempts have been made to increase the crossbow power stroke through the use of an inverted limb technology. In an inverted limb technology, the concavity of the limb faces towards the target. However, the inverted limb approach is generally more difficult to use, requires modifications to traditional archery techniques, and does not improve vibration tolerance of the crossbow. Further, the inverted limb approach increases the overall profile size of the crossbow because less of the barrel is within the profile, leading potentially to sensitive components being vulnerable to damage when the crossbow is placed on the ground.

An additional disadvantage with conventional crossbow designs relates to the placement of the bowstrings and the power cords. Specifically, because the barrel of the crossbow resides in the space between the bowstrings and the power cord, sufficient spacing is required for the arrow and its fletching to pass through the space without interference. With the conventional crossbow designs, the power cord is routed, at a downward angle, through a slot in the barrel.

This angle, which is relatively large, can cause several problems related to the crossbow. First, the power cable force, applied at this relatively large angle, causes or urges the cams to lean or tilt. This tilting can cause asymmetric rotation and bearing function of the cams and can also increase the wear and tear on the bearings. This tilting can also cause the limbs to twist relative to each other or otherwise assume a distorted shape. In addition, the application of the power cable force along this relatively large angle can lead to inefficiency and loss of force transmission from the power cable to the limbs during the firing of the crossbow. All of these problems can result in both a decrease in shooting performance and increased wear and tear on components, and can require more frequent replacement of power cables and other components of the crossbow.

The foregoing background describes some, but not necessarily all, of the problems, disadvantages and shortcomings related to conventional archery bow technology.

SUMMARY

In an embodiment, a rotor support system includes a first portion and a second portion. The first portion includes a limb coupler configured to be coupled to a first limb of a crossbow. The crossbow is configured to be aimed forward toward a target. The crossbow includes a barrel configured to extend along a longitudinal axis. The first limb includes: (a) an inner limb surface configured to at least partially face toward the longitudinal axis when the crossbow is in a cocked condition; and (b) a first limb end. The crossbow includes a second limb comprising a second limb end. A vertical plane extends between the first and second limb ends. The vertical plane intersects with the longitudinal axis when the crossbow is horizontally oriented and aimed toward the target. The second portion includes a rotor coupler configured to be coupled to a rotor of the crossbow. The rotor is configured to rotate about a rotary axis. The rotor coupler is configured to position the rotor so that the rotary axis is located forward of the vertical plane when the crossbow is in the cocked condition and when the crossbow is in an un-cocked condition.

In an embodiment, a rotor support system includes a limb coupler and a rotor coupler. The limb coupler is configured to be moveably coupled to a crossbow limb of an archery crossbow so as to enable a first movement of the limb coupler relative to the crossbow limb. The rotor coupler is configured to be moveably coupled to a rotor of the archery crossbow so as to enable a second movement of the rotor relative to the rotor coupler. The limb coupler and the rotor coupler are operably coupled.

In an embodiment, a method for manufacturing a rotor support system includes: structuring a limb coupler so that the limb coupler is configured to be moveably coupled to a crossbow limb of an archery crossbow so as to enable a first movement of the limb coupler relative to the crossbow limb; structuring a rotor coupler so that the rotor coupler is configured to be moveably coupled to a rotor of the archery crossbow so as to enable a second movement of the rotor relative to the rotor coupler; and structuring the limb coupler and the rotor coupler to be operably coupled.

Additional features and advantages of the present disclosure are described in, and will be apparent from, the following Brief Description of the Drawings and Detailed Description.

BRIEF DESCRIPTION OF THE DRAWINGS

FIG. 1A1 is an isometric view of the crossbow of FIG. 1A, in the uncocked condition.

DETAILED DESCRIPTION

The present disclosure relates to rotors and rotor-related devices for use in archery bows. Generally stated, a rotor support system can couple a rotor to a limb of an archery bow, such as a crossbow. A rotor support system as set forth herein, e.g., that includes a rotor coupler and a limb coupler that are moveably coupled to the rotor and the limb, respectively, can overcome numerous deficiencies of conventional techniques. For instance, in one example, the limb coupler can allow the rotor to be spaced toward the central access of the crossbow to facilitate the rotor being within the footprint of the limbs, allowing the rotor to be protected when the crossbow is handled or set on the ground. In addition, having two moveable couplers for the limb and rotor can reduce the vibrational oscillation encountered when the crossbow is fired, thus increasing accuracy. For example, the extra degrees of rotational freedom can be used to store energy in the rotary horizontal plane rather than in the orthogonal vertical plane, reducing vertical oscillatory energy of the crossbow upon firing.

Another advantage of the present disclosure is that the rotors, through the placement enabled by the rotor support system, can take up more of the bowstring upon being drawn, even if the rotors are forward of a line connecting the limb ends. A further advantage relates to reducing the angle between the bowstrings and the power cord by the provision of a rotor coupler that is relatively thicker than conventional rotor couplers, thus reducing the amount of force that is transmitted in the vertical plane instead of the desired forward direction.

Figure 1A:
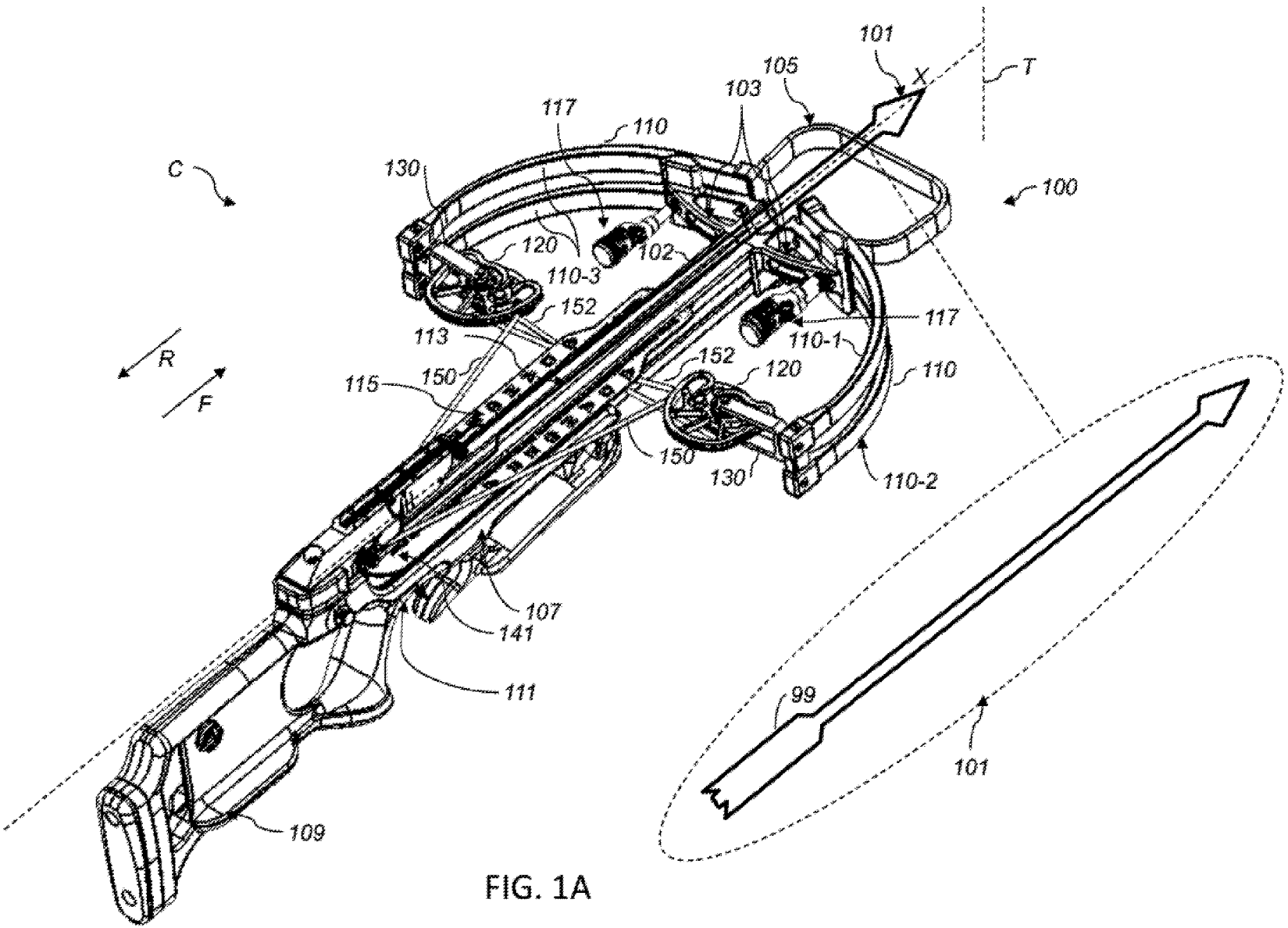
FIG. 1A is an isometric view of an embodiment of a crossbow, in the cocked condition.

By way of overview, FIGS. 1A-1G are isometric views of one embodiment of a crossbow 100. As shown in FIG. 1A, the crossbow 100 is in a full draw position or cocked condition C, with a bolt or arrow 101 aimed at a target T, which could be located hundreds of yards away from the crossbow 100. In an embodiment, the crossbow 100 includes: a barrel 102; a riser 103 supported by the barrel 102; a cocking stirrup 105 coupled to the riser 103 for receiving a user's foot during cocking of the crossbow 100; a plurality of limbs 110 supported by the riser 103; a foregrip 107 coupled to the barrel 102; a stock 109 coupled to, and extending rearward from, the foregrip 107; a trigger 111 pivotally coupled to the foregrip 107; a flight groove or arrow track 113 supported by the barrel 102; a finger guard 115 moveably coupled to the barrel 102 to protect the archer's thumbs or other fingers from entering the arrow track 113; a plurality of draw cord stoppers 117 configured to engage and support the drawstring 150 when the crossbow 100 is in the brace or uncocked condition U (FIG. 2B); a plurality of cams or rotors 120; a plurality of rotor support systems 130 that rotatably couple the rotors 120 to the limbs 110; and a plurality of cords coupled to the rotors 120, including a bowstring or drawstring 150 and a power line, power cord set, power cable set or supplemental cord set 152, which includes a plurality of supplemental cord segments extending in an X-arrangement between the rotors 120.

In an embodiment, the crossbow 100 includes some or all of the components, parts and elements (some of which are not shown) of a commercially-available crossbow, including, but not limited to, a draw cord latch, a hook or drawstring holder 141 configured to hold the draw cord 150 after the draw cord 150 has been fully drawn rearward, an arrow retention spring configured to engage or stabilize the arrow 101, an internal trigger mechanism operatively coupled to both such drawstring holder 141 and the trigger 111, and a safety switch, button or device.

In an embodiment, the barrel 102 extends along a longitudinal axis X of the crossbow 100. In operation, the arrow 101 is slideably positioned within the arrow track 113 of the crossbow 100 after the crossbow 100 is cocked. The crossbow 100 may be placed into the cocked condition C by drawing back the drawstring 150 in a rearward direction R away from the target T. The rearward direction R is opposite of the forward direction F. As may be seen from the illustrated embodiment of FIG. 1A, when the crossbow 100 is cocked, the drawstring 150 is tensioned backwards, away from the target T.

In an embodiment, to aid in the cocking process, the user can place the user's foot through the opening 119 (FIG. 1A1) defined by the cocking stirrup 105. Placing the foot on the ground, the user can pull upward on the draw cord 150 with the user's hands or through use of a suitable cocking aid. Once the crossbow 100 reaches the cocked condition C, the draw cord holder 141 hooks onto and holds the draw cord 150. Then, the user can operate the safety device to secure the draw cord holder 141 in the holding position. Next, the user can install the arrow 101 in the arrow track 115. Next, the user can operate the safety device to enable movement of the draw cord holder 141. Finally, the user can pull the trigger 111, which causes the draw cord holder 141 to release the draw cord 150 which, in turn, pushes the arrow 101 forward toward the target T.

In an embodiment, the limb 110, rotor support system 130 and rotor 120 located on one side of axis X are identical to the limb 110, rotor support system 130 and rotor 120 located on the other side of axis X. Accordingly, the description herein of each such component with respect to one side of axis X, applies to the description of the counterpart component on the other side of axis X.

Each limb 110 may include one or more limb portions, such as limb segments 110-1, 110-2 arranged in a split configuration. Each of the limb segments 110-1, 110-2 has an inner limb surface 110-3 (FIGS. 1A and 1B) that at least partially faces toward the longitudinal axis X when the crossbow 100 is in the cocked condition C shown in FIG. 1A. In one example, the barrel 102 and the limb 110 may be constructed from fiberglass. In another example, the cords, such as the drawstring 150 and the supplemental cords 152, may be constructed from any appropriate material, such as fabric, nylon or another suitable polymer.

In an embodiment, each rotor 110 includes an eccentric cam configured to rotate about an axis. Each such cam has one or more elliptical, asymmetric or non-circular lever portions configured to: (a) engage the drawstring 150; (b) engage the supplemental cord set 152; or (c) engage both the bowstring 150 and the supplemental cord set 152. The drawstring 150 and supplemental cord set 152 are spooled on the rotors 110. In an embodiment, rotor 120 includes a draw cord groove 120-1 configured so that a substantially horizontal plane $B_1$ (FIG. 1G) extends through the draw cord groove 120-1. The draw cord groove 120-1 is configured to receive draw cord 150. The rotor 120 also includes a supplemental cord groove 120-2 configured so that a substantially horizontal plane $B_2$ (FIG. 1G) extends through the supplemental cord groove 120-2, which is configured to receive supplement cord 152.

Figure 1B:
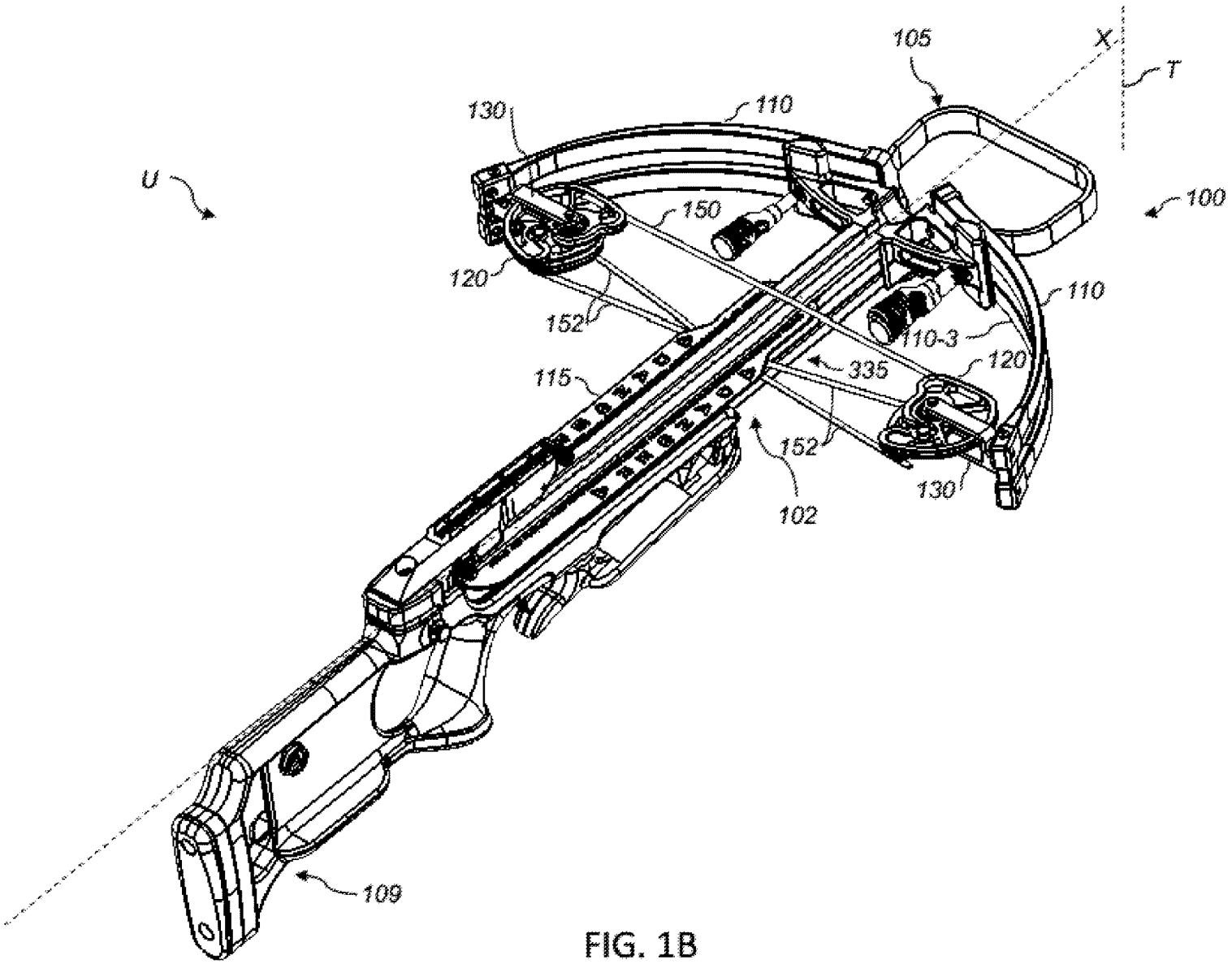
FIG. 1B is an isometric view of the crossbow of FIG. 1A, in the uncocked condition.

The operation of the crossbow 100, as well as the drawstring 150 may be further understood by reference to FIG. 1B, which shows crossbow 100 in the brace position or un-cocked condition U. As illustrated in FIG. 1B, the drawstring 150 is perpendicular (or substantially perpendicular) to axis X of the barrel 102 when the crossbow 100 in the un-cocked condition U. As may be visualized from FIGS. 1A and B, if the draw cord 150 has been pulled rearward and the crossbow 100 is in the cocked condition C, the crossbow 100 may propel the arrow 101 forward upon being triggered, and will subsequently maintain the un-cocked condition C.

Figure 1D:
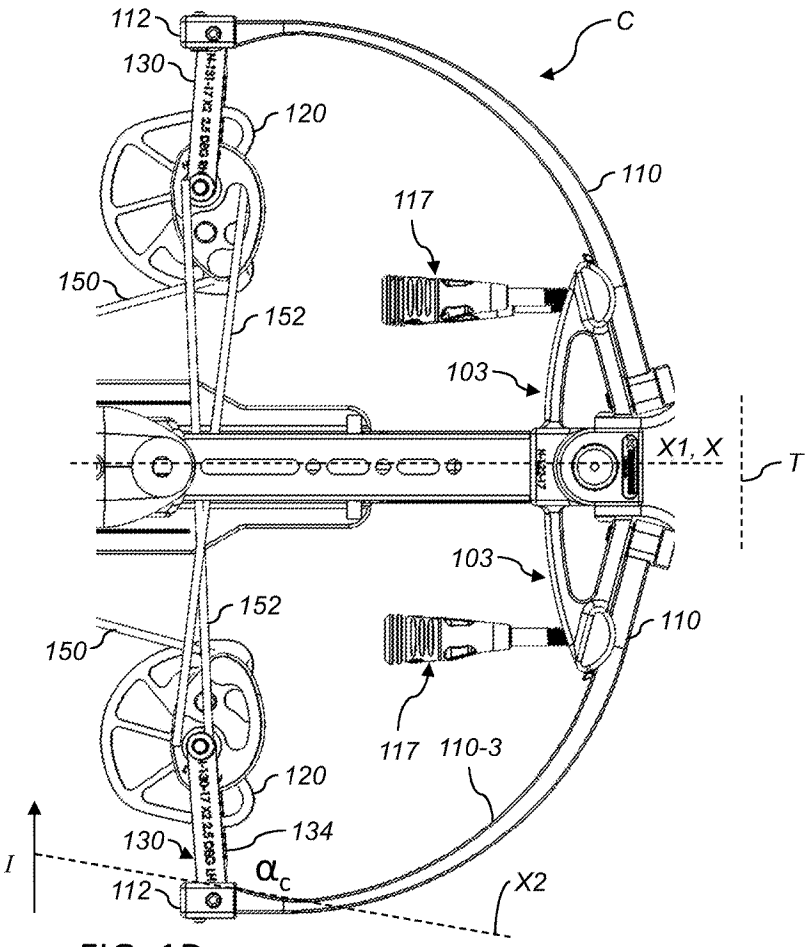
FIG. 1D is a partial top view of the crossbow of FIG. 1A, in the cocked condition.
Figure 1C:
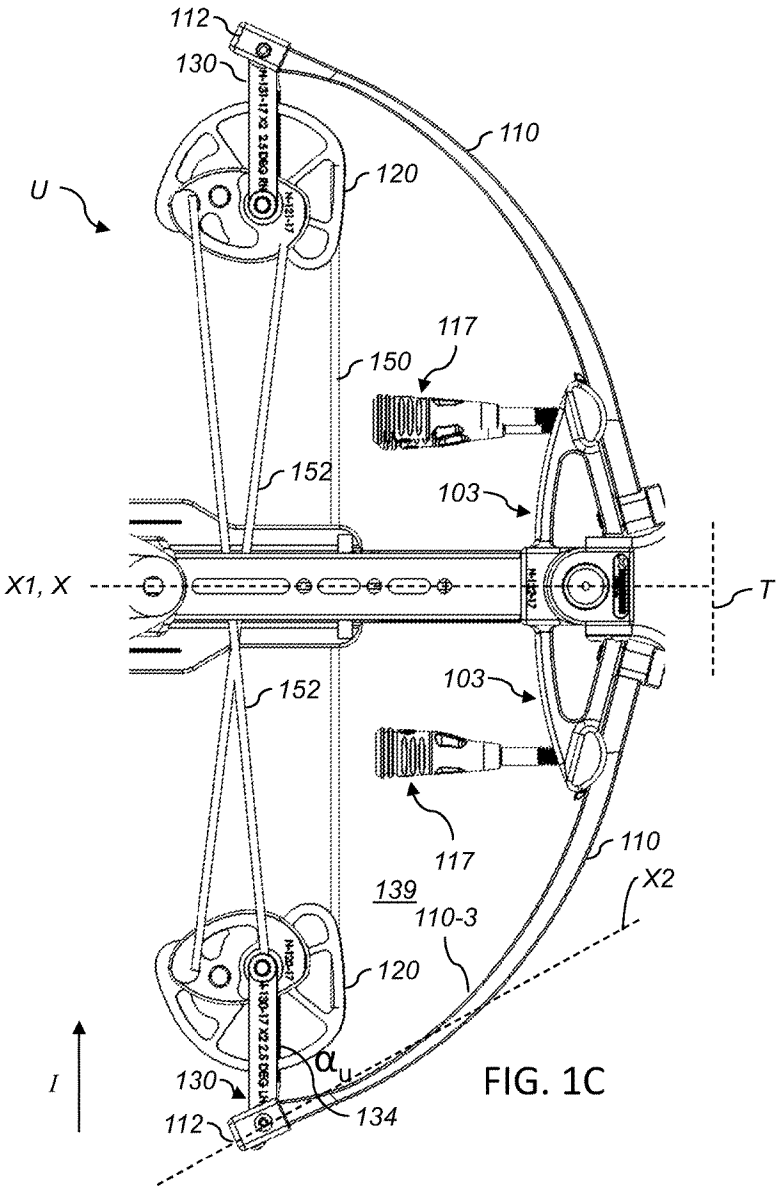
FIG. 1C is a partial top view of the crossbow of FIG. 1A, in the uncocked condition.

FIGS. 1C and 1D are plan views taken from the bottom of the crossbow 100, that is from a position in which the arrow 101 (FIG. 1A) is not visible due to being located above the barrel 102. FIG. 1C shows the crossbow 100 in the un-cocked condition U, and FIG. 1D shows the crossbow 100 in the cocked condition C. Also shown in FIGS. 1C and 1D are the rotors 120 and rotor support systems 130.

Readily apparent by comparing FIGS. 1C and 1D is that, in the cocked condition C, each limb 110 bends or flexes in the inward direction I toward axis X of barrel 102. Furthermore, when the crossbow 100 is transitioned from the uncocked condition U to the cocked condition C, the angle between the rotor support system 130 and the limb 110 changes from $\alpha_u$ to $\alpha_c$. This is because, as described below, each rotor support system 130 is pivotally coupled to one of the limbs 110. Note that X2 in FIG. 1C represents the line and vertical plane that is tangent to a portion of the limb 110. Thus, in the cocked condition C, limb 110 at least partially faces towards the barrel 102 (and the longitudinal axis X). However, in the uncocked condition U, limb 110 at least partially faces away from the barrel 102 (and the longitudinal axis X).

Advantageously, the rotor support system 130 also positions the rotor 110 so that the rotary axis $A_2$ is located at or slightly forward of the rotary axis $A_1$ when the crossbow 100 is in the uncocked condition U and backward of the rotary axis $A_1$ when the crossbow is in the cocked condition, indicative of the storage of the drawing energy due to the two degrees of rotational freedom of the rotor support system (e.g., via the rotor coupler and the limb coupler).

In operation, when the crossbow 100 is triggered from the cocked condition C and releases to the un-cocked condition U, the limbs 110 and the drawstring 150 both contribute considerable force to the arrow 101. The force propels the arrow 101 forward.

Figure 1E:
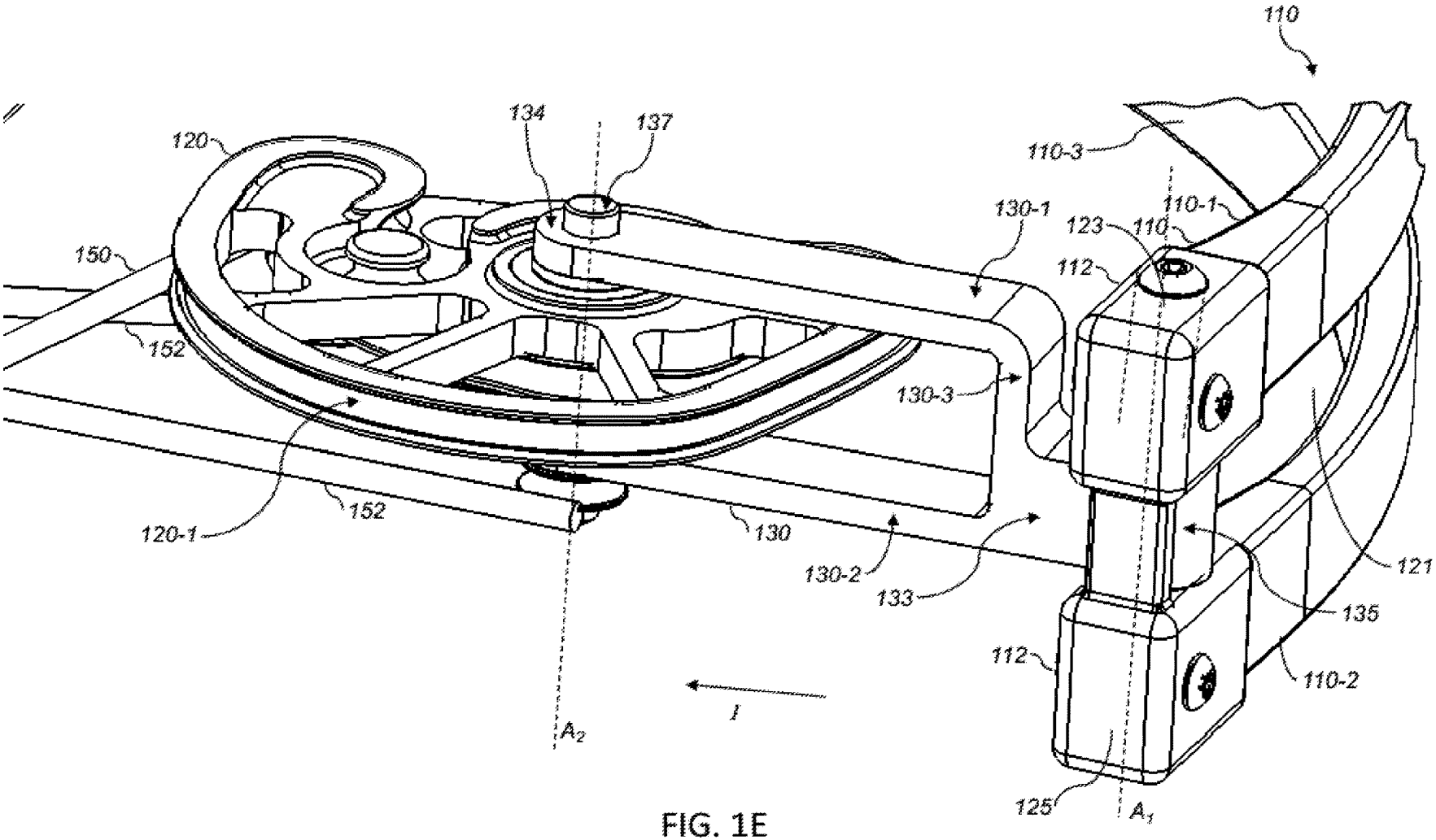
FIG. 1E is an enlarged isometric view of the crossbow of FIG. 1A, in the uncocked condition.
Figure 1F:
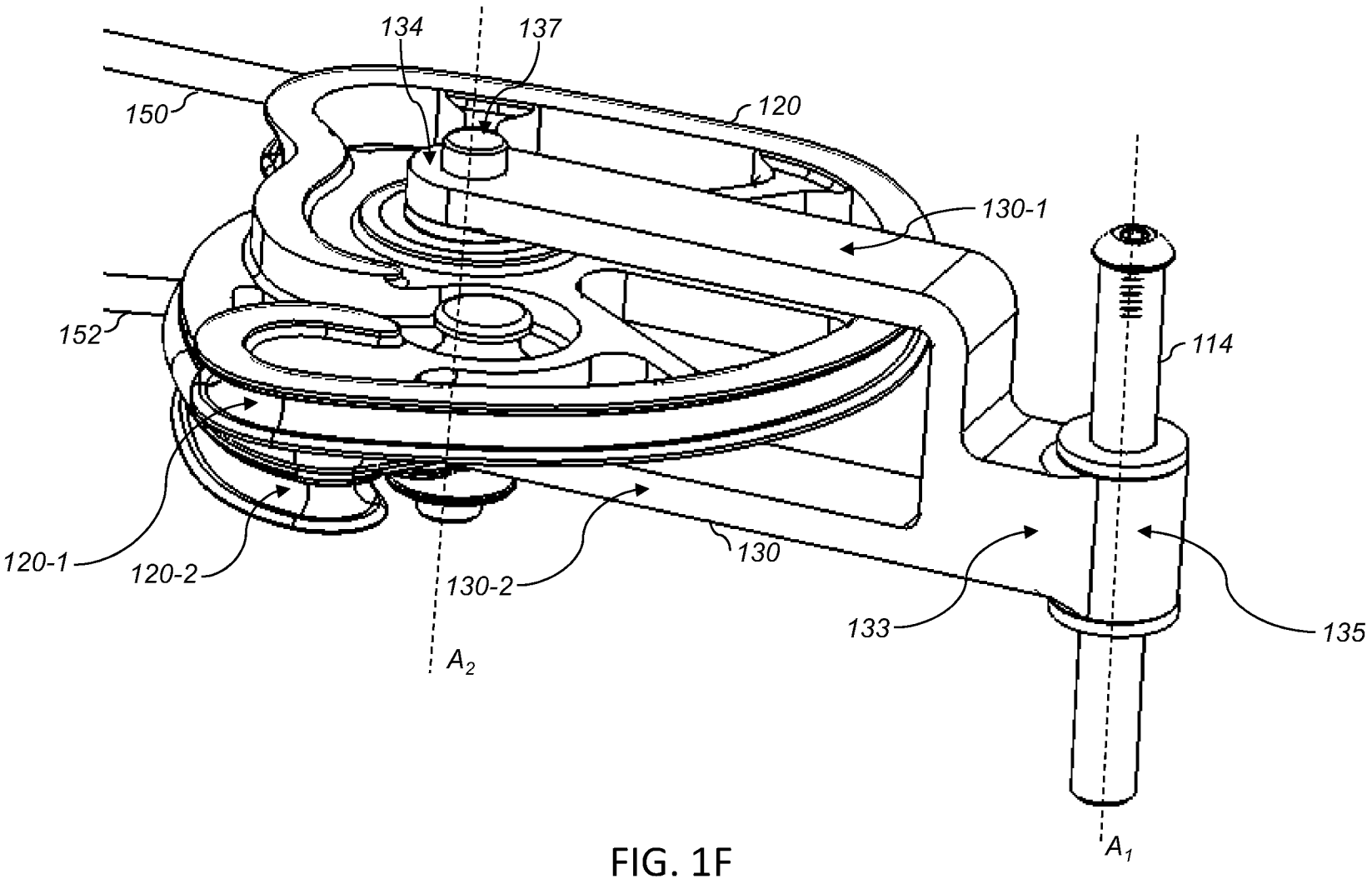
FIG. 1F is a detailed view of FIG. 1E, with certain components hidden for purposes of exposition.

Next, FIG. 1E illustrates an enlarged isometric view of the crossbow 100 of FIG. 1B in the un-cocked condition, and FIG. 1F elides the limbs 110 so that the rotor support system 130 may be viewed in further detail. With reference to FIGS. 1E and 1F, in an embodiment, each of the rotor support systems 130 includes a limb coupler 133 and a rotor coupler 134. In the illustrated embodiment, the limb coupler 133 is moveably coupled to the limb 110. As shown in FIG. 1C and FIG. 1D, the limb coupler 133 enables a first movement (e.g. a pivot action) of the limb coupler 133 of the rotor support system 130 relative to the limb 110, and an angle therebetween changes from $\alpha_u$ in the un-cocked condition U to $\alpha_c$ in the cocked condition C.

As further shown in FIGS. 1E and 1F, the rotor coupler 134 is moveably coupled to the rotor 120. The rotor coupler 134 enables a second movement (e.g., rotation action) of the rotor 120 relative to the rotor coupler 134 of the rotor support system 130, enabling the rotor 120 to rotate from a first position in the un-cocked condition C to a second position in the cocked condition C.

In addition, note that the rotor 120 is positioned so that the rotary axis A2 is located forward of the limb ends 112 when the crossbow 100 is in the cocked condition C, and located even more forward when the crossbow is in an un-cocked condition U.

Another advantage of the split limb configuration of FIG. 1E is that the rotor 120 may be more readily centered with respect to the thickness of the crossbow 100 in the vertical direction, or may be offset instead of being centered. In either case, tuning the position can be used to reduce any undesirable angle in the power cords and bowstrings, thus the improved crossbows of the present disclosure facilitate reducing the vibrational modes of oscillation previously described above.

In an embodiment, the bare ends (not shown) of the limbs 110 include a fiberglass grain or layered structure that makes the limbs 110 vulnerable to deterioration or damage. As shown in FIG. 1E, the crossbow 100 includes protective covers or endcaps 112 at the bare ends of the limb segments 110-1, 110-2. Each endcap 112 is configured to cover and protect the bare ends of one of the limbs 110.

The limb coupler 133 and the rotor coupler 134 enable movements of the limb 110 and rotor 120 that are independent. For example, the limb coupler 133 is configured to pivot relative to limb 110, and this pivoting is independent of the rotation of rotor 120 relative to rotor coupler 134. Advantageously, the independence of the movements enables a plurality of degrees of freedom during the transition between the cocked to un-cocked conditions C, U. In an embodiment, these multiple degrees of freedom advantageously enable for more of the energy to be transferred into the forward movement of the arrow 105, instead of being dissipated in the limbs 110 in the form of vibrational energy leading to unwanted oscillations. Thus, the improved rotor support system advances the crossbow art by providing a user with enhanced stability during firing. As an additional improvement, the degree of freedom between the limb coupler 133 and the limb 110 reduces the accumulation of harmful stress, strain or a combination thereof in the limb 110.

In an embodiment, the limb coupler 133 is configured to have multiple degrees of freedom relative to limb 110. For example, the axle 114 can be replaced with a ball joint that enables the limb coupler 133 to have three hundred sixty degrees of movement relative to the limb 110 during the transition between uncocked and cocked conditions U, C.

Figure 1G:
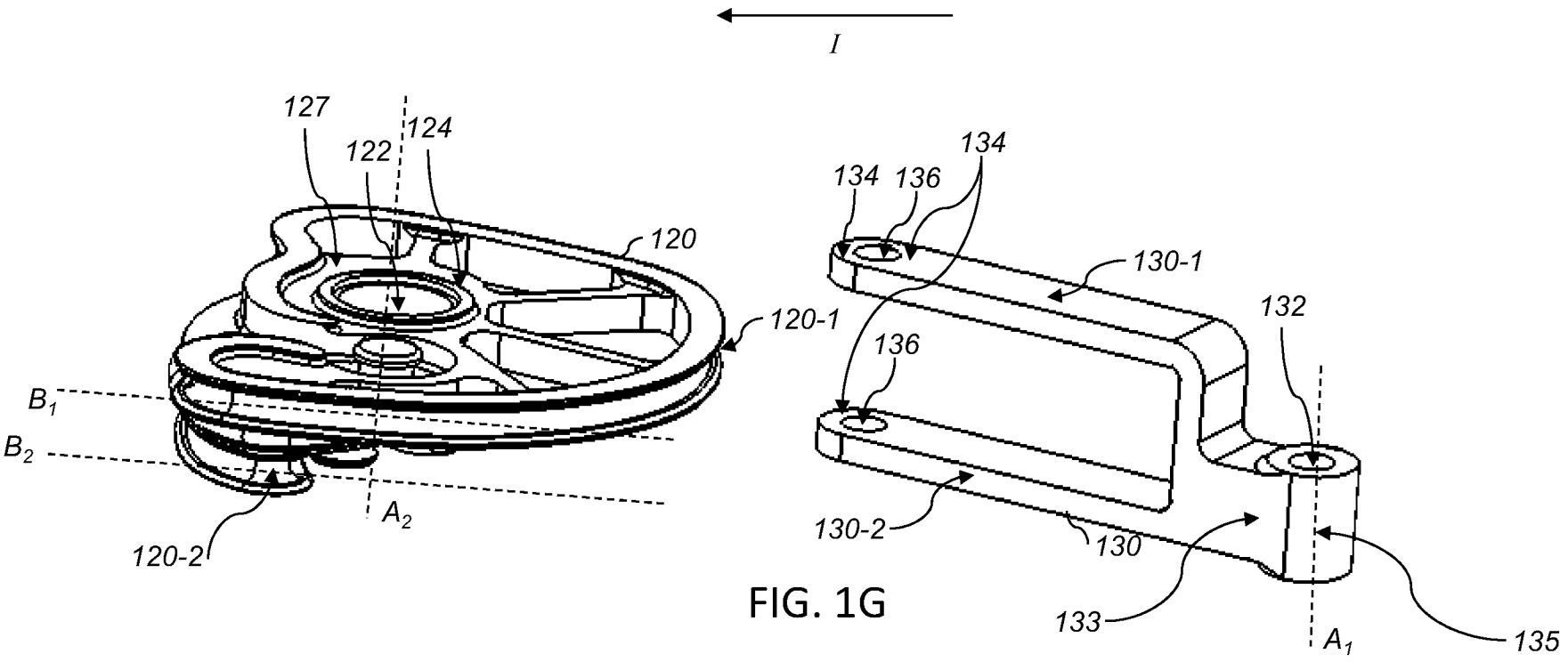
FIG. 1G is an exploded view of the detailed view of FIG. 1F, with certain components hidden for purposes of exposition.

Further details of the rotor support system 130 may be seen with respect to the exploded view of FIG. 1G. For instance, in an embodiment, the rotor support system 130 has one or more extensions or fork arms 130-1, 130-2 for rotary engagement to the rotor 120. As shown in FIG. 1E, the lower fork arm 130-2 extends substantially horizontally from the central gap 121 between the limb segments 110-1, 110-2. A horizontal plane extends along or through the upper fork arm 130-1 substantially above central gap 121 as a consequence of the upward offset section 130-3. As an advantage, the fork arms 130-1, 130-2, which allow for rotary engagement, enable greater stability in the coupling to facilitate improved accuracy and reduction of vibration during firing of the crossbow.

It should be understood that, during cocking of crossbow 100, the supplemental cord groove 120-2 can experience a substantially higher force, at times, than the cord groove 120-1. This force differential can cause or urge the rotor 120 to tilt or lean, which can cause problems as described below. The upward offset section 130-3 is configured to locate the grooves 120-1, 120-2 in or along planes $B_1$, $B_2$, respectively, to compensate for such force differential. For example, the offset section 130-3 locates the supplemental cord groove 120-2 vertically closer to the central gap 121 than the draw cord groove 120-1, which can bear less force than supplemental cord groove 120-2.

Returning to the illustrated embodiment of FIG. 1E, the limb coupler 133, which is configured to be coupled to the limb segments 110-1, 110-2, is shown in the coupled configuration. As shown, the limb segments 110-1, 110-2, separated by a central gap 121, each define a limb cavity, such as limb cavity 123 defined by limb segment 110-1 and limb cavity 125 defined by limb segment 110-2, each of which is located on a first axis $A_1$. Continuing with this embodiment, the limb coupler 133 includes a limb interface 135 configured to fit within gap 121 at least partially between the limb segments 110-1, 110-2. Next, as more readily visible in FIG. 1G, the limb interface 135 defines a first cavity 132 located on the first axis $A_1$ when the limb coupler 133 is coupled to the set of limb segments 110-1, 110-2. In addition, each of the fork arms 130-1, 130-2 of rotor coupler 134 defines a cavity 136, as shown in FIG. 1G.

In the example shown, limb cavities 123 and 125 (FIG. 1E) are channels or passageways that pass entirely through the limb segments 110-1 and 110-2, respectively. Also, in the example shown, cavity 132 (FIG. 1G) is a channel or passageway that passes entirely through the limb coupler 133. In addition, the cavities 136 are channels or passageways that pass entirely through the fork arms 130-1, 130-2. However, depending upon the embodiment, some or all of such cavities 123, 125, 132, 136 can extend only partially through the structure defining such cavities. In such embodiments, one or more of such cavities 123, 125, 132, 136 can include depressions that do not pass entirely through the defining structure. This configuration may be suitable, for example, for a rotor coupler that has a single arm connected to the rotor 120.

In another embodiment not shown, the limb 110 is replaced with a unitary limb structure having a single limb segment instead of two segments 110-1, 110-2. In such embodiment, the limb coupler 133 excludes the limb interface 135. Instead, the limb coupler 133 includes a connector, such as a hinge or ball joint, that moveably couples the rotor support system 130 to the unitary limb structure. In such embodiment, the limb coupler 133 is not inserted into any cavity or portion of the unitary limb structure.

With respect to FIG. 1G, the rotor coupler 134 is configured to be coupled to the rotor 120, and is shown in the coupled configuration. In addition, the rotor 120 includes a rotor portion 127 configured to rotate about a second axis $A_2$. The rotor portion 127 defines a rotor cavity 122. The rotor coupler 134 extends in the inward direction I from the axis $A_1$ to the axis $A_2$. As shown in FIGS. 1C-1D, the rotor coupler 134 extends from the inner limb surface 110-3 toward the longitudinal axis X. The rotor portion 123 has a rotor interface 124 that defines the rotor cavity 122 that is centered about the axis $A_2$.

Considering the axes $A_1$, $A_2$ in further detail as shown in FIG. 1F, a first axle 114 is present in the axis $A_1$ to couple the limb coupler 133 to the limb segments 110-1, 110-2. As shown, the first axle 114 extends along the first axis $A_1$, and is at least partially inserted into the limb cavity 132 (FIG. 1G). Similarly, a second axle 137 (FIGS. 1E and 1F) is configured to couple the rotor coupler 134 to the rotor 120. The second axle 137 extends along the second axis $A_2$, and is inserted through cavities 136 and rotor cavity 122.

As shown in FIGS. 1C and 1D, the rotor coupler 134 is configured to keep the rotor 120 within a bow space 139 that is located fully or partially between a first vertical plane X1 and a second vertical plane X2. In an embodiment, the rotor 120 remains within bow space 139 during the transitioning of the crossbow 100 between the cocked condition C and un-cocked condition U. In the example shown, plane X1 is the plane in which axis X lies, and plane X is vertical or substantially vertical when the barrel 102 (and therefore axis X) is oriented horizontally when the crossbow 100 is aimed at a target T. In this example, plane X2 is parallel to plane X1, and plane X2 is tangential to a portion of the inner limb surface 110-3. It should be appreciated that plane X2 can extend tangential to any portion of inner limb surface 110-3, not limited to the portion illustrated in FIGS. 1C and 1D.

It should be appreciated that, depending upon the embodiment, the axle 114 (FIG. 1F) can extend partway through (and not entirely through) limb 110. In an embodiment not shown, the rotor support system 130 is configured to be moveably coupled to limb 110 without the use of an axle. For example, the limb coupler 133 can be pivotally, swivelly or otherwise moveably coupled to the inner limb surface 110-3 through the inclusion of a hinge, ball joint, pivot member or other suitable fastener or joint.

In terms of manufacturing, the crossbow 100 set forth above may be readily manufactured by structuring a limb coupler 133 and a rotor coupler 134 as described above.

Figure 2A:
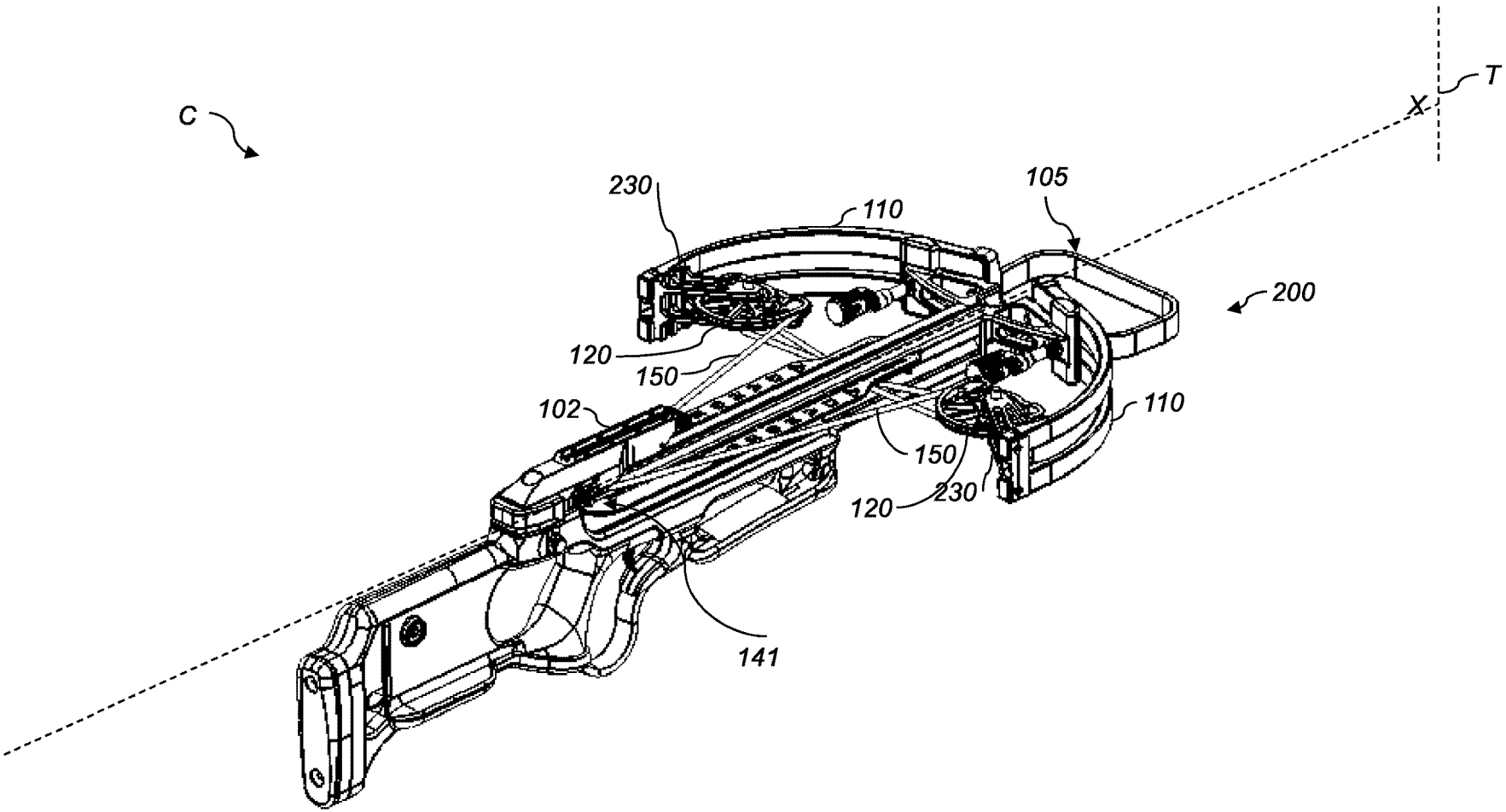
FIG. 2A is an isometric view of an embodiment of a crossbow, in the cocked condition.
Figure 2B:
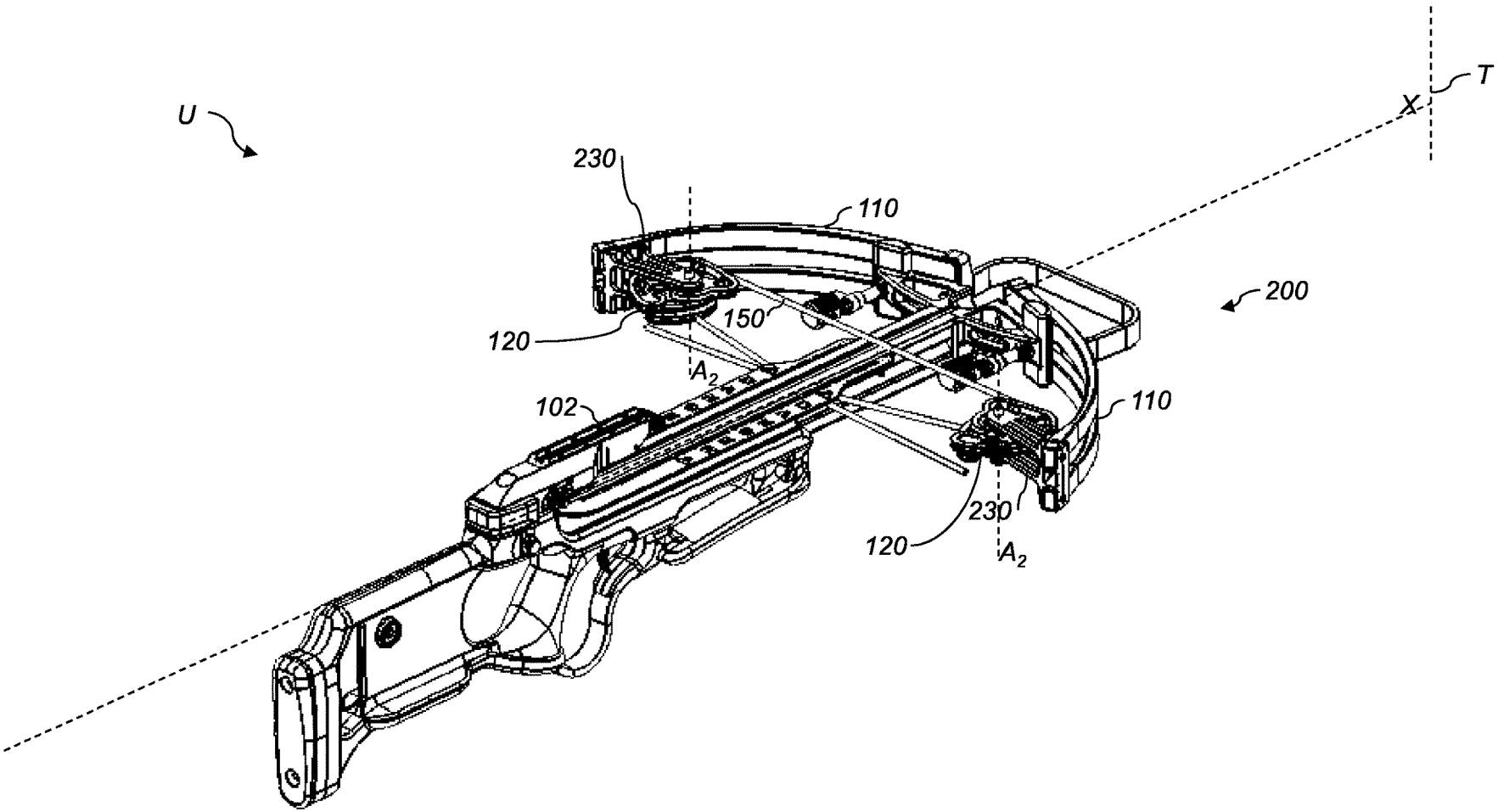
FIG. 2B is an isometric view of the crossbow of FIG. 2A, in the uncocked condition.

In another embodiment shown in FIGS. 2A-2G, crossbow 200 has the same structure, components, parts and functionality of crossbow 100 except that rotor support systems 230 replace rotor support systems 130. In this embodiment, each rotor support system 230 includes a fixed bracket that is fixedly connectable to the limb 110. As described below, each rotor support system 230 rotatably couples one of the rotors 120 to one of the limbs 110, enabling a single degree of freedom. FIG. 2A shows a crossbow 200 having rotor support system 230 in the cocked condition C. FIG. 2B shows the crossbow 200 in the un-cocked condition U.

In an embodiment, the limb 110, rotor support system 230 and rotor 120 located on one side of axis X are identical to limb 110, rotor support system 230 and rotor 120 located on the other side of axis X. Accordingly, the description herein of each such component with respect to one side of axis X, applies to the description of the counterpart component on the other side of axis X.

Figure 2D:
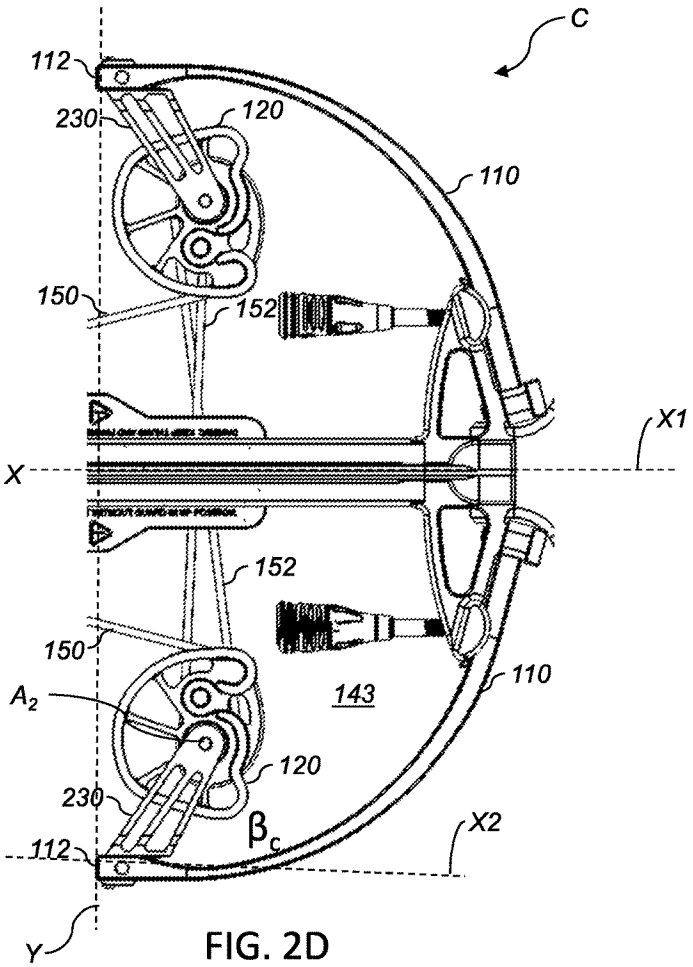
FIG. 2D is a partial top view of the crossbow of FIG. 2A, in the cocked condition.
Figure 2C:
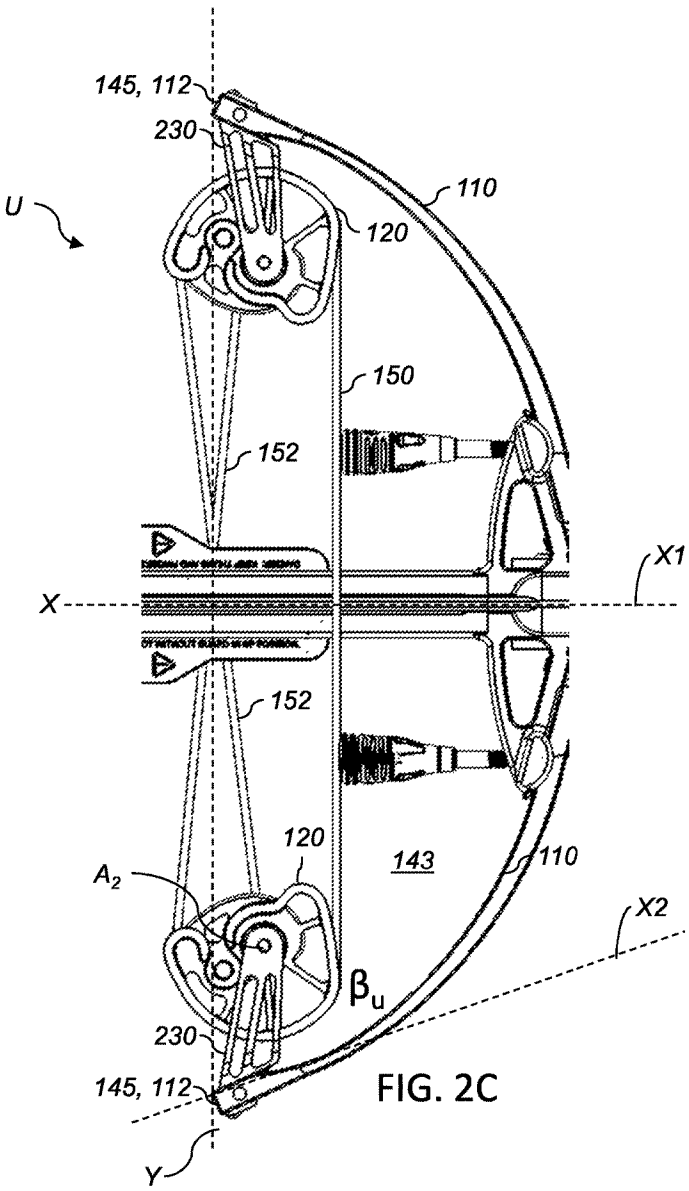
FIG. 2C is a partial top view of the crossbow of FIG. 2A, in the uncocked condition.

As shown in FIGS. 2C-2D, rotor support system 230 of FIGS. 2A-2G includes a bracket, body or other structure that is fixedly connected to the inner limb surface 110-3 through suitable fasteners. As described below, the rotor support system 230 maintains part or all of the rotor 110 within the bow space 143 during the uncocked condition U, cocked condition C or during both such conditions U, C. In this embodiment, the bow space 143 is located fully or partially between planes X1 and X2, and the bow space 143 is located forward of vertical plane Y. As shown, plane Y extends between limb tips 145 and is perpendicular to (or substantially perpendicular to) plane X1. In the embodiment shown:

(a) the rotor support system 230 is configured to position the axis $A_2$ within the bow space 143 during the uncocked and cocked conditions U, C;

(b) the rotor support system 230 is configured to position over half of the rotor 120 within the bow space 143 during the uncocked condition U; and (c) the rotor support system 230 is configured to position all the rotor 120 within the bow space 143 during the cocked condition C.

Advantageously, the improved rotor support system 230 of FIGS. 2C-2D is configured to position the rotor 110 so that the rotor 10 is located forward of the vertical plane Y when the crossbow is in the cocked position, essentially allowing the entirety of the rotor to be within the space of the limbs, facilitating a compact crossbow with enhanced power. Such an improvement advances crossbow technology to allow for crossbows with superior protection from damage without sacrificing power.

This positioning locates the rotor axis $A_2$ further from the drawstring holder 141 (FIG. 2A) than prior art crossbows. The increased distance between the rotor 120 and drawstring holder 141 increases the power stroke of the crossbow 200. In other words, when cocking from a standing position with the user's foot in the stirrup 105, this positioning enables the user to achieve full cocking without having to pull as far high as prior art crossbows. This improvement in crossbow design provides an advantage for users with lower upper body strength.

In another embodiment, the rotor support system 230 is moveably (e.g., slideably) coupled to the limb 110. For example, through a slot and groove arrangement, the rotor support system 230 can slide while cooperatively or matingly engaged with the limb 110. Once the user reaches the desired position (forward or rearward) along the limb 110, the user can insert or operate a suitable fastener (e.g., a set screw) to secure the rotor support system 230 in place on the limb 110. This embodiment enables the user to adjust the power stroke according to the user's upper body strength, anatomy and preferences.

Figure 2E:
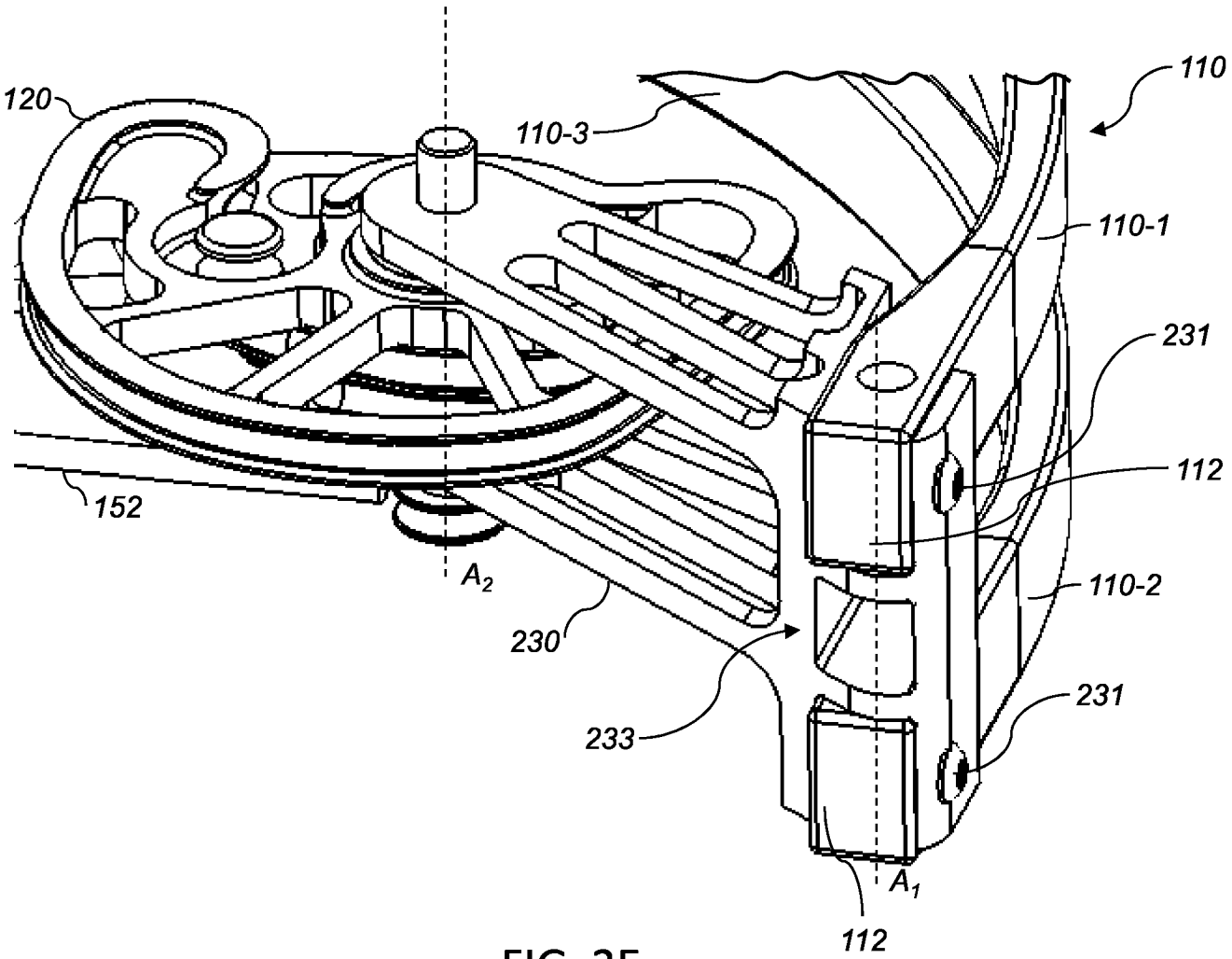
FIG. 2E is an enlarged isometric view of the crossbow of FIG. 2A, in the cocked condition.
Figure 2F:
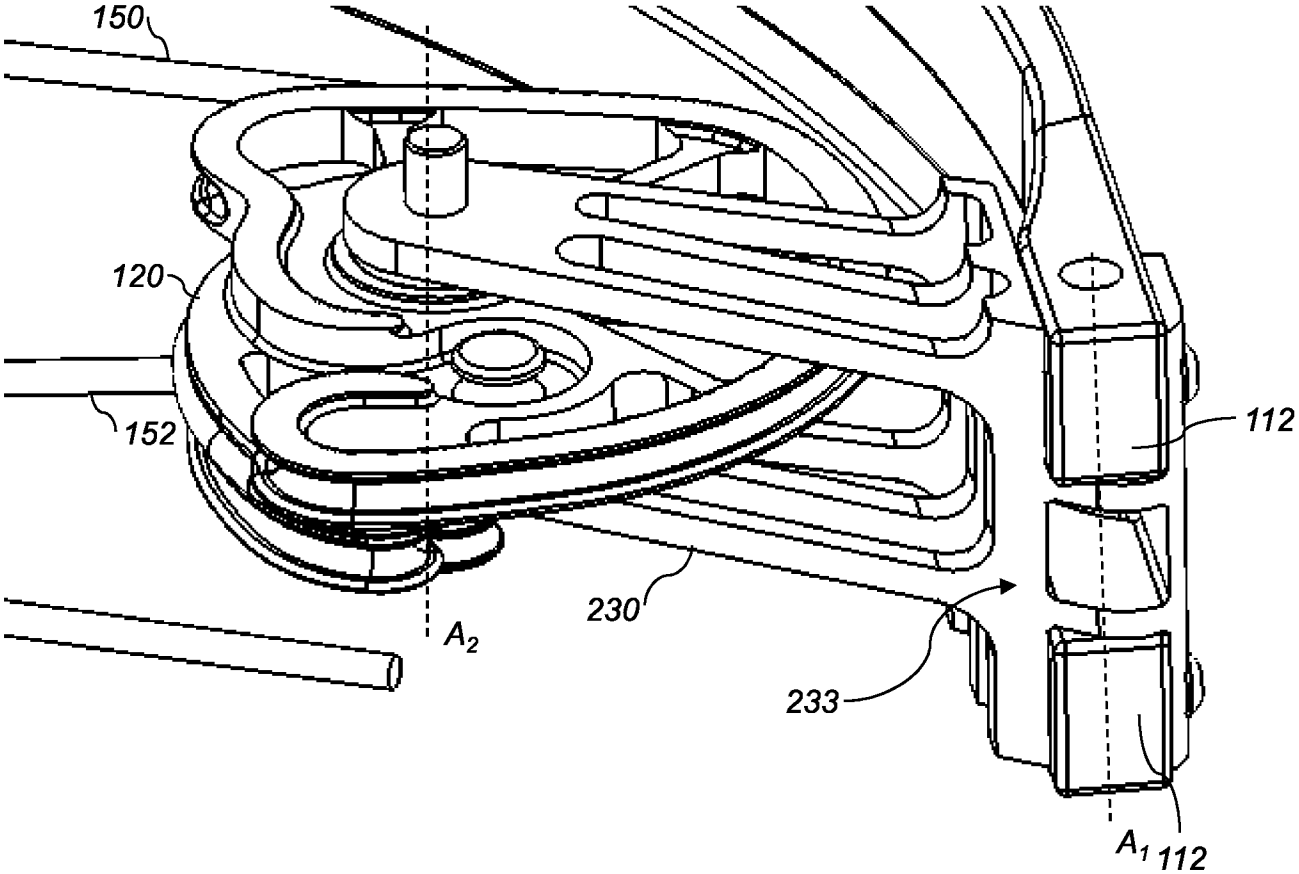
FIG. 2F is an enlarged isometric view of the crossbow of FIG. 2A, in the uncocked condition.
Figure 2G:
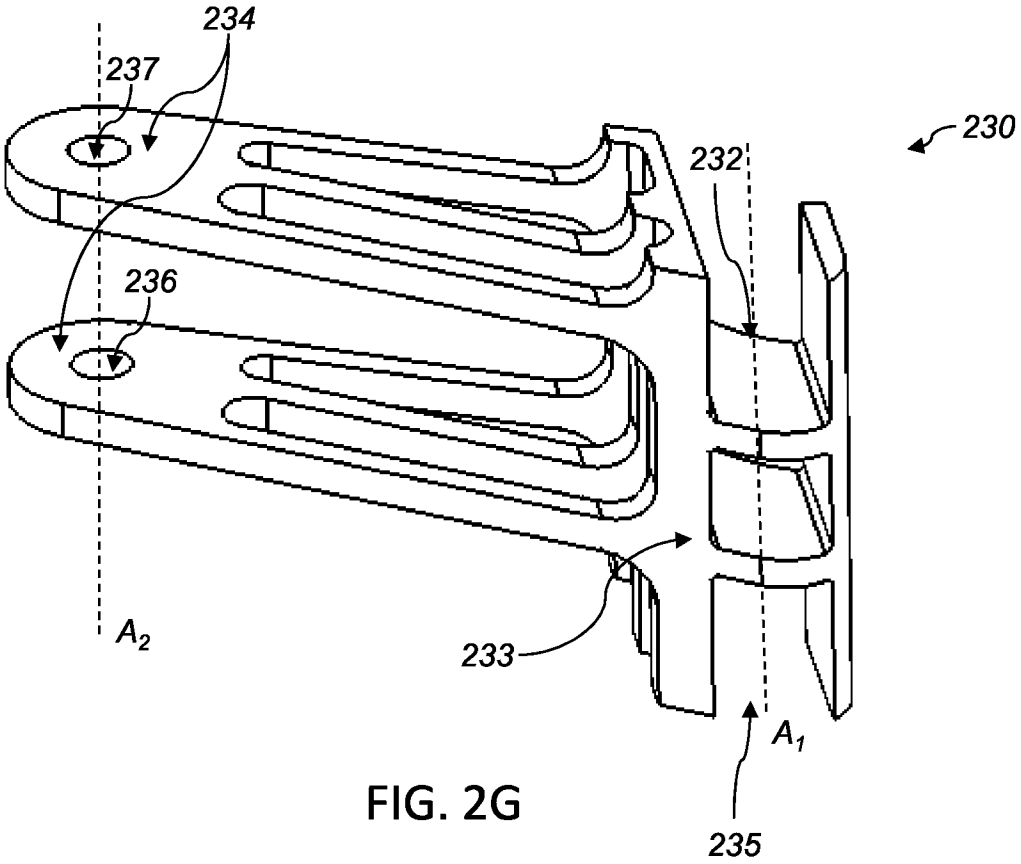
FIG. 2G is an isometric view of the rotor support system of the crossbow of FIG. 2A.

As shown in the fragmentary view of FIG. 2G, rotor support system 230 defines cavities 232, 235 in a limb coupler 233. The cavities 232, 235 are configured to receive end portions of the limb segments 110-1, 110-2, respectively, for engagement with the limb 110. The rotor support system 230 also defines a plurality of cavities 236, 237 in a rotor coupler 234 for engagement with the rotor 120. In the embodiment shown, the cavities 236, 237 are channels or passageways that pass entirely through the rotor coupler 234. Depending upon the embodiment, one or both of the cavities 236, 237 can extend only partially through the rotor coupler 234. In such embodiment, one or both of such cavities 236, 237 can include depressions that do not pass entirely through the rotor coupler 234.

In another embodiment not shown, the limb 110 is replaced with a unitary limb structure having a single limb segment instead of two segments 110-1, 110-2. In such embodiment, the limb coupler 233 excludes the limb interface 235. Instead, the limb coupler 233 includes a fastener, such as one or more screws or bolts, that fixedly mount the rotor support system 230 to the inner limb surface of the unitary limb structure. In such embodiment, the limb coupler 233 is not inserted into any cavity or portion of the unitary limb structure.

In another embodiment shown in FIGS. 3A-3E, crossbow 300 has the same structure, components, parts and functionality of crossbow 100 or crossbow 200 except that rotor 320 replaces rotor 120. In an embodiment, the limb 110, rotor support system 130 or 230, and rotor 320 located on one side of axis X are identical to limb 110, rotor support system 130 or 230 and rotor 320 located on the other side of axis X. Accordingly, the description herein of each such component with respect to one side of axis X, applies to the description of the counterpart component on the other side of axis X.

Figure 3A:
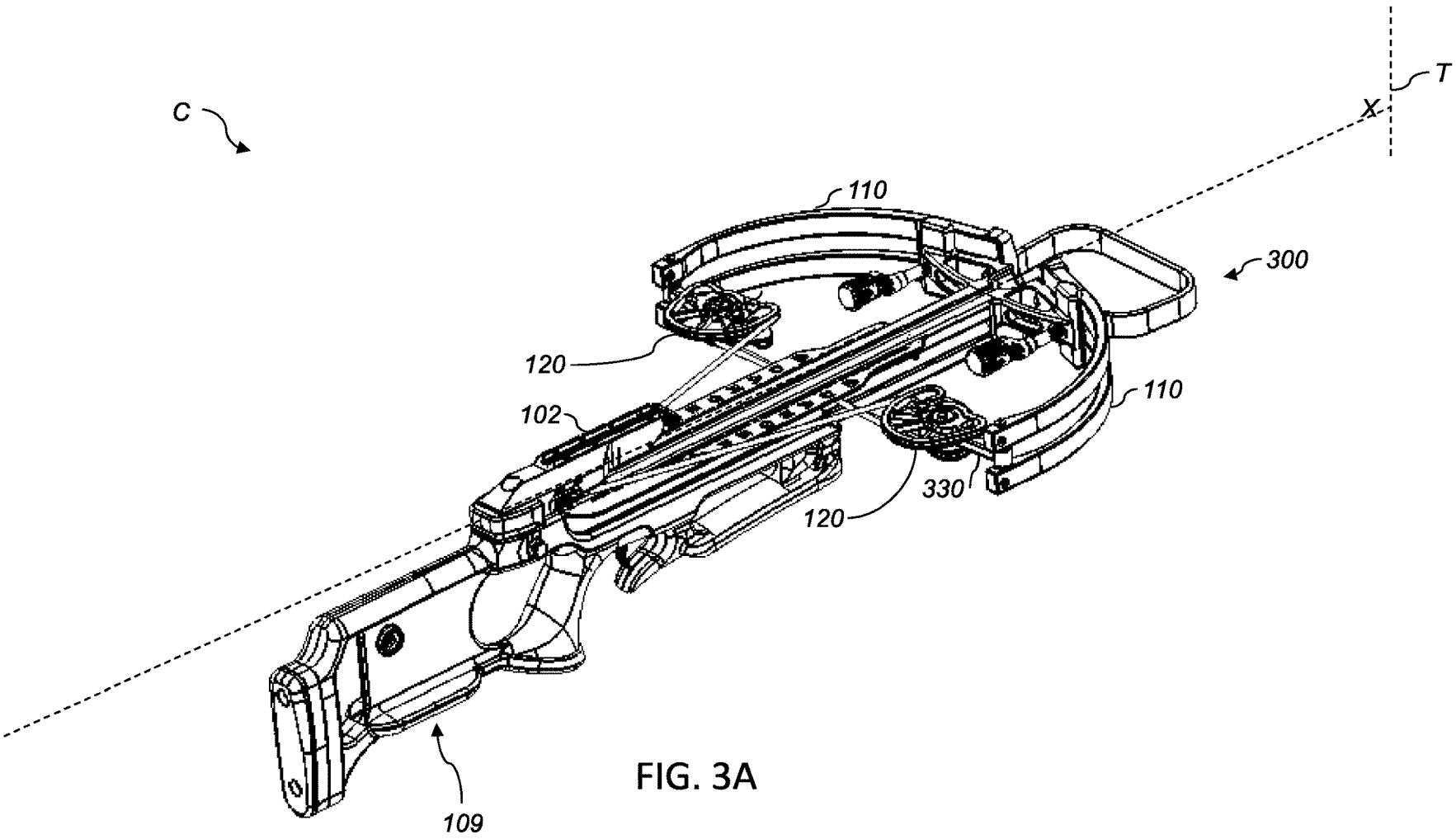
FIG. 3A is an isometric view of an embodiment of a crossbow, in the cocked condition.
Figure 3B:
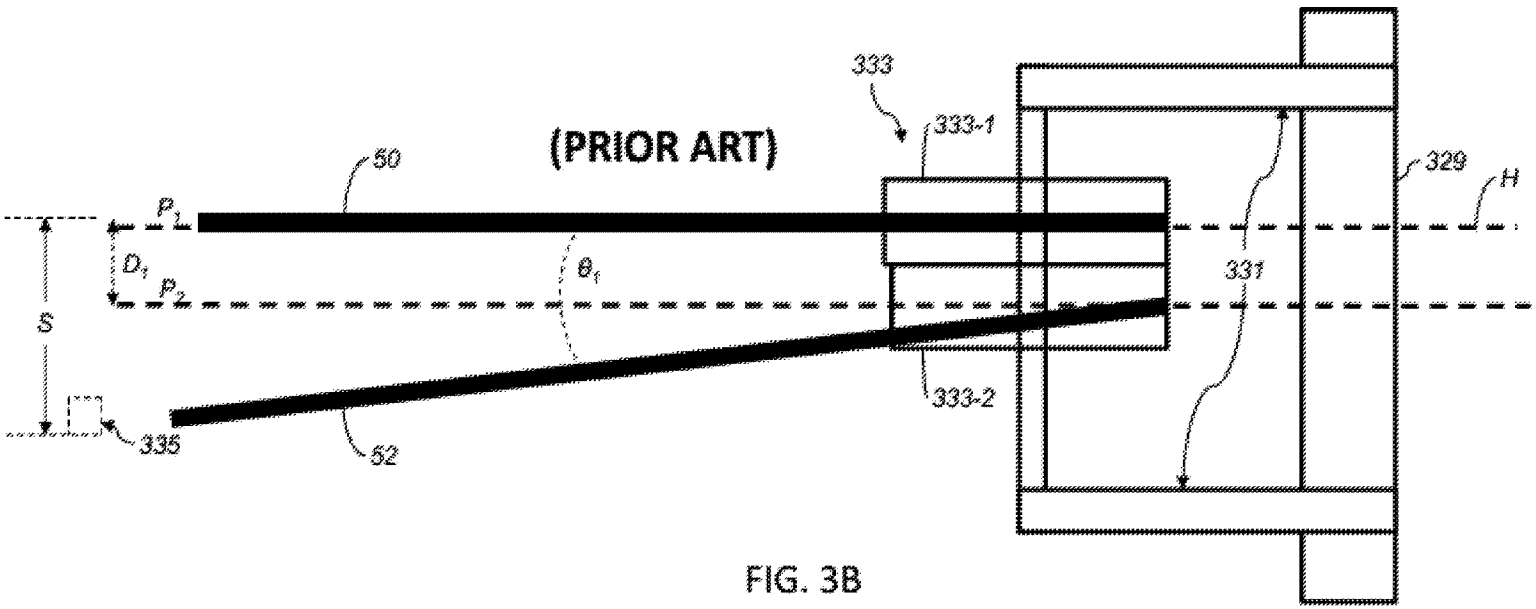
FIG. 3B is a schematic diagram of a prior art rotor.

As described below, the rotor 320 has a relatively thick profile configured to accommodate the incoming angles of the drawstring 150 and supplemental cord 152 so as to reduce harmful effects of such angles. As shown in FIG. 3B, the prior art has a limb 329 that supports a plurality of arms 331 that rotatably hold a cam 333. The cam 333 has a draw cord groove 333-1 located in or along a first plane $P_1$ for receiving a draw cord 50. Plane $P_1$ is typically horizontal or substantially horizontal when the crossbow is oriented horizontally. The cam 333 also has a supplemental cord groove 333-2 located in or along a second plane $P_2$ for receiving a supplemental cord 52.

Referring back to FIGS. 1A1 and 1B, the supplemental cord 152 is routed downward toward axis X (FIG. 1B) to pass through the barrel slot 335 defined by the barrel 102. In the example shown, barrel slot 335 is located a distance S below the first plane $P_1$. This routing and distance S provides important clearance for the arrow 101 and its fletching 99 as the arrow departs the crossbow. However, in the prior art, this routing also causes the supplement cord 52 to extend downward at a relatively large angle relative to horizontal. Because of the profile of cam 333, only a relatively small dimension $D_1$ separates the first plane $P_1$ and the second plane $P_2$, so that the supplemental cord 52 is offset at an angle $\theta_1$ from the horizontal axis H. Angle $\theta_1$ can be greater than 5°. As described above, numerous disadvantages can flow from the use of such a large angle $\theta_1$, including, but not limited to, considerable vibration or twisting of the crossbow during operation, leaning or tilting of the cam 333, asymmetric rotation or wobbling of the cam 333, impairment of the cam bearing function, increased wear and tear on the cam 333, twisting or distortion of split limbs 329, and inefficiency and loss of force transmission from the supplemental cord 52 to the limb 329 during the firing of the crossbow.

Figure 3C:
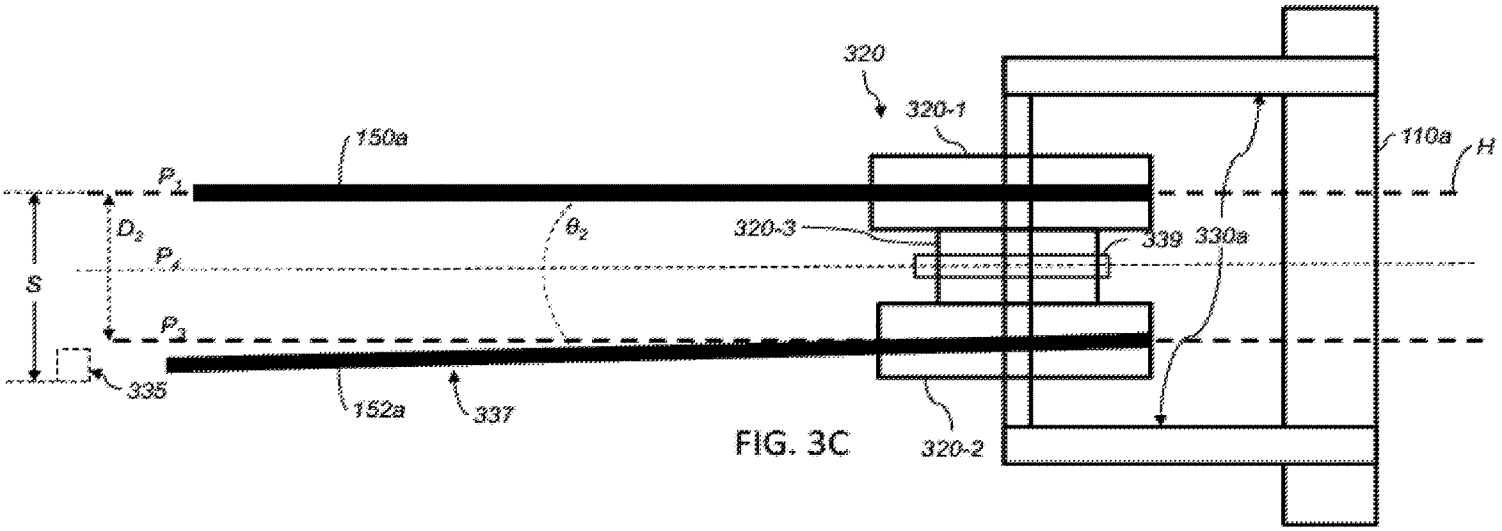
FIG. 3C is a schematic diagram of an embodiment of a rotor.

The rotor 320, shown in FIG. 3C, overcomes or lessens such disadvantages of the prior art cam 333. That is because the improved crossbow rotor 320 reduces the asymmetric rotation or wobbling described above. As shown in FIG. 3C, the rotor 320 includes: a pulley, slot, groove or draw cord engager 320-1 located in or along plane $P_1$ aligned to receive a draw cord 150*a*; a pulley, slot, groove or supplemental cord engager 320-2 located in or along plane $P_3$ aligned to receive a power or supplemental cord 152*a*; and an intermediary portion 320-3 located in or along plane $P_4$. The intermediary portion 320-3 separates the draw cord engager 320-1 from the supplemental cord engager 320-2 so that there is a dimension $D_2$ between the planes $P_3$ and P4. Dimension $D_2$ is significantly or substantially greater than $D_1$ of prior art cam 333. Accordingly, this greater dimension $D_2$ causes a supplemental cord path 337 that routes the supplemental cord 152*a* to the barrel slot 335, which is still located distance S below the plane $P_1$. Accordingly, the rotor 320 serves the arrow clearance role by maintaining distance S while substantially decreasing angle $\theta_2$ between supplemental cord 152*a* and horizontal plane H. In the example shown, angle $\theta_2$ is less than 5° below horizontal plane H. This reduction in the downward angle (e.g., the use of a $\theta_2<5°$) greatly eliminates or reduces the problems described above with respect to the prior art cam 333. Advantageously, the angle $\theta_2$ causes an increase in a force that is: (a) transferred from the supplemental cord 52 to the supplemental cord engager 320-2; and (b) acts within the plane $P_3$.

The intermediary portion 320-3 shown in FIG. 3C has a diameter that is less than the diameters of the draw cord engager 320-1 and supplemental cord engager 320-2. This gives the rotor 320 a dumbbell or dog bone shape. It should be appreciated, however, that in other embodiments, the diameter of the intermediary portion 320-3 can be the same as or greater than the diameters of the draw cord engager 320-1 and supplemental cord engager 320-2.

In an embodiment, the rotor 320 includes a vibration dampener 339 than encircles the intermediary portion 320-3. The vibration dampener 339 is configured to absorb vibrations that are transmitted through the crossbow 300 and rotor 320 during operation of the crossbow 300. In an embodiment, the vibration dampener 339 includes an elastic band, O-ring or other flexible or non-flexible layer, coating or material, including, but not limited to, a natural or synthetic rubber or a suitable polymer.

Figure 3D:
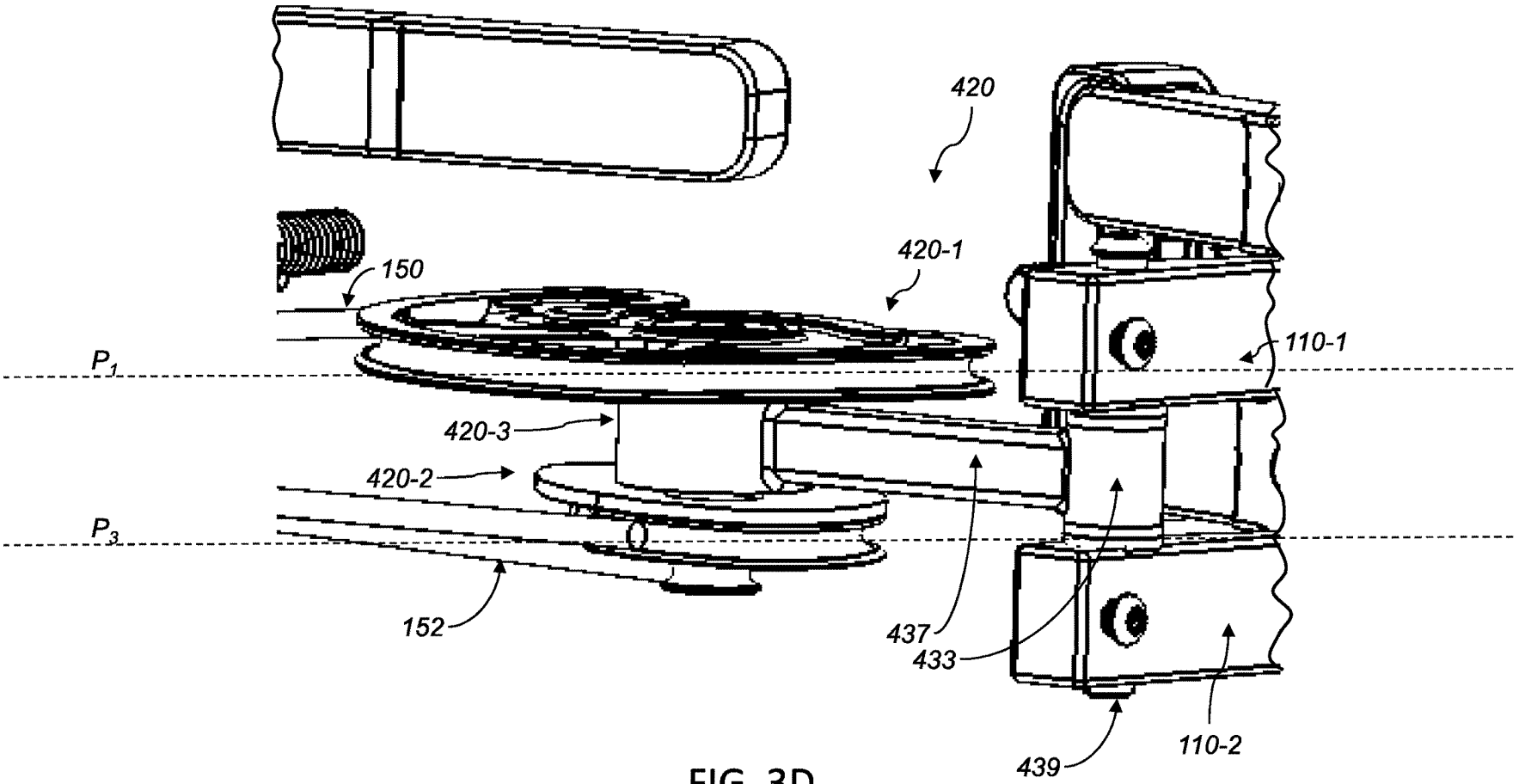
FIG. 3D is an isometric view of an embodiment of a rotor assembly.
Figure 3E:
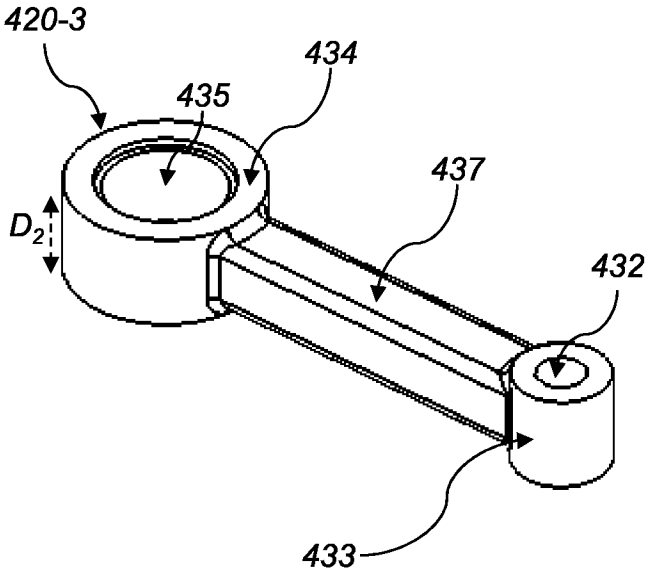
FIG. 3E is an isometric view of an embodiment of an intermediary portion of the rotor assembly of FIG. 3D.

In an embodiment illustrated in FIGS. 3D-3E, rotor assembly 420 includes: a draw cord engager 420-1 located in or along plane $P_1$ and receiving draw cord 150; a supplemental cord engager 420-2 located in or along plane $P_3$ and receiving supplemental cord 152; and an intermediary portion 420-3 that spaces draw cord engager 420-1 apart from a supplemental cord engager 420-2. Because of the intermediary portion 420-3, the rotor assembly 420 eliminates or reduces the problems described above with respect to the prior art cam 333.

As shown in FIG. 3E, in an embodiment, the intermediary portion 420-3 defines a passageway 435. In this embodiment, the rotor assembly 420 includes: an axle (not shown) that extends through passageway 435 to rotatably couple the draw cord engager 420-1 and supplemental cord engager 420-2 to the limb 110; an arm or extension 437; a limb coupler 432 configured to pivotally couple the extension 437 to the limb 110; and an axle 439 configured to be inserted through the passageway 432 defined by the limb coupler 432. In an embodiment, the intermediary portion 420-3 has a rotor interface 434, and the limb coupler 432 has a limb interface 433. The generally dog bone shape of the rotor support system of FIG. 3E enables tuning of the relative diameters of the axles as well as independent selection of the thickness of either end to support appropriate shaped rotors.

Therefore, as noted in the corresponding description above, FIGS. 3A-3E generally disclose an improved archery rotor having a draw cord engager, a supplemental cord engager, and an intermediary portion between the draw cord engager and the supplement cord engager. In an example, the draw cord engager defines a first groove located in or along a first plane, e.g., where the first groove is configured to receive a draw cord. In an example, the supplemental cord engager defines a second groove located in or along a second plane, e.g., where the second groove is configured to receive a supplemental cord, and where the supplemental cord is directed from a first location in or along the second plane, along a cord path to a second location positioned off of the second plane. In an example, the intermediary portion is disposed between the draw cord engager and the supplement cord engager, e.g., where the intermediary portion comprises a dimension between the first and second planes. In an example, as a result of the dimension the cord path extends at a second angle relative to the second plane, and the second angle causes an increase in a force that is: (a) transferred from the supplemental cord to the second grove; and (b) acts within the second plane, both improving the amount of power delivered and improving the accuracy of the delivered power.

Suitable fasteners can be used to connect or couple together the various components described above. Depending upon the embodiment, the fasteners can include bolts, nuts, screws, nuts, washers, pins, clips, springs, welding, adhesives and other fasteners. For example, bolts or screws 231 are used to fixedly connect limb coupler 233 to limb 110 as shown in FIG. 2E.

As described above, each limb of each of the crossbows 100, 200, 300 has a split configuration defined by a plurality of spaced-apart limb segments. In other embodiments not shown, such crossbows have two unitary limbs, branching to each side of the barrel. Each such unitary limb has as single limb segment that is coupled to one of the following: rotor support system 130, rotor support system 230, rotor 320, rotor assembly 420 or any combination thereof.

It should be appreciated that rotor support systems 130, 230, rotor 320, rotor assembly 420 or any combination thereof can be incorporated into any type of archery bow, not necessarily a crossbow. For example, an embodiment includes a vertical bow, compound bow, recurve bow or fishing bow that includes rotor support system 130, rotor support system 230, rotor 320, rotor assembly 420 or any combination thereof. In such embodiment, such compound bow is configured to be transitioned between a brace or undrawn condition (analogous to uncocked condition U of a crossbow) and a retracted or full draw condition (analogous to cocked condition C of a crossbow).

The embodiments described herein include certain structural elements that configured to have positions relative to designated planes. An element may be described as extending through, within or along a plane. Also, an element may be described as having a plane extend through, within or along the element.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above. For example, in an embodiment, each one of the crossbows 100, 200, 300 includes part or all of one or more of the rotor support system 130, rotor support system 230, rotor 320, rotor assembly 420 or any combination thereof.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A rotor support system comprising:

a first portion comprising a limb coupler configured to be coupled to a first limb of a crossbow, the crossbow configured to be aimed forward toward a target, wherein:

the crossbow comprises a barrel configured to extend along a longitudinal axis;

the first limb comprises: (a) an inner limb surface configured to at least partially face toward the longitudinal axis when the crossbow is in a cocked condition; and (b) a first limb end; and the crossbow comprises a second limb comprising a second limb end, wherein: (a) a vertical plane extends between the first and second limb ends; (b) the vertical plane intersects with the longitudinal axis when the crossbow is horizontally oriented and aimed toward the target; and a second portion comprising a rotor coupler configured to be coupled to a rotor of the crossbow, wherein:

the rotor is configured to rotate about a rotary axis; and the rotor coupler is configured to position the rotor so that the rotary axis is located forward of the vertical plane when the crossbow is in the cocked condition and when the crossbow is in an un-cocked condition.

2. The rotor support system of claim 1, wherein the limb coupler is configured to be rotatably coupled to the first limb of the crossbow at a second rotary axis.

3. The rotor support system of claim 1, wherein the limb coupler is configured to be rotatably coupled to the first limb of the crossbow at a second rotary axis wherein the rotor coupler is configured to position the rotor so that the rotary axis is located forward of the second rotary axis when the crossbow is in the uncocked condition and forward of the second rotary axis when the crossbow is in the cocked condition.

4. The rotor support system of claim 1, wherein the rotor coupler is configured to position the rotor so that the rotor is located forward of the vertical plane when the crossbow is in the cocked condition.

5. The rotor support system of claim 1, wherein the rotor coupler comprises fork arms for rotary engagement to the rotor.

6. The rotor support system of claim 1, wherein the rotor support system has a generally dog bone shape in which the second portion is larger than the first portion.

7. The rotor support system of claim 1, wherein the first limb of the crossbow comprises a set of limb segments, and the limb coupler comprises a limb interface configured to fit at least partially between the limb segments.

8. The rotor support system of claim 1, wherein the first portion defines a limb cavity located on a first axis, and the limb coupler comprises a limb coupler cavity located on the first axis when the limb coupler is coupled to the first limb, and the rotor support system further comprises a first axle configured to couple the limb coupler to the first limb wherein the first axle extends along the first axis, is at least partially inserted into the limb cavity, and is at least partially inserted into the limb coupler cavity.

9. The rotor support system of claim 1, further comprising a second axle configured to couple the rotor coupler to the rotor wherein the second axle extends along the second axis.

10. The rotor support system of claim 1, wherein a second axle is at least partially inserted into a rotor cavity of the rotor, and is at least partially inserted into a rotor coupler cavity of the rotor coupler.

11. A rotor support system comprising:

a limb coupler configured to be moveably coupled to a crossbow limb of an archery crossbow so as to enable a first movement of the limb coupler relative to the crossbow limb; and a rotor coupler configured to be moveably coupled to a rotor of the archery crossbow so as to enable a second movement of the rotor relative to the rotor coupler, wherein the limb coupler and the rotor coupler are operably coupled, and wherein the limb coupler is configured to be rotatably coupled to the crossbow limb of the archery crossbow.

12. The rotor support system of claim 11, wherein the limb coupler and the rotor coupler are configured to enable the first movement to occur independent of the second movement.

13. The rotor support system of claim 11, wherein:

the archery crossbow is configured to be aimed forward toward a target;

the rotor is rototable about a first axis;

the limb coupler is rototable about a second axis; and the rotor coupler is configured to maintain the first axis forward of the second axis in uncocked and cocked conditions of the archery crossbow.

14. The rotor support system of claim 11, wherein:

the crossbow limb comprises a first limb end;

the archery crossbow comprises a second crossbow limb;

the second crossbow limb comprises a second limb end;

a vertical plane extends between the first and second limb ends;

the vertical plane intersects with a longitudinal axis of the archery crossbow when the archery crossbow is horizontally oriented and aimed toward a target;

the rotor is rototable about a first axis;

the limb coupler is rototable about a second axis; and the first and second axes are positioned forward of the vertical plane when the archery crossbow is in uncocked and cocked conditions.

15. A rotor support system comprising:

a limb coupler configured to be moveably coupled to a crossbow limb of an archery crossbow so as to enable a first movement of the limb coupler relative to the crossbow limb; and a rotor coupler configured to be moveably coupled to a rotor of the archery crossbow so as to enable a second movement of the rotor relative to the rotor coupler, wherein the limb coupler and the rotor coupler are operably coupled, wherein the rotor is rotatable about a first axis, wherein the archery crossbow is operable to launch a projectile in a forward direction, and wherein the limb coupler is configured to be rotatably coupled to the crossbow limb of the archery crossbow and to be rotatable about a second axis, wherein the rotor coupler is configured to position the rotor so that the first axis is located forward of the second axis when the crossbow is in an uncocked condition and forward of the second axis when the crossbow is in a cocked condition.

16. The rotor support system of claim 15, wherein:

the crossbow limb comprises a first limb end;

the archery crossbow comprises a second crossbow limb;

the second crossbow limb comprises a second limb end;

a vertical plane extends between the first and second limb ends;

the vertical plane intersects with a longitudinal axis of the archery crossbow when the archery crossbow is horizontally oriented and aimed toward a target; and the first and second axes are positioned forward of the vertical plane when the archery crossbow is in uncocked and cocked conditions.

17. A rotor support system comprising:

a limb coupler configured to be moveably coupled to a crossbow limb of an archery crossbow so as to enable a first movement of the limb coupler relative to the crossbow limb; and a rotor coupler configured to be moveably coupled to a rotor of the archery crossbow so as to enable a second movement of the rotor relative to the rotor coupler, wherein the limb coupler and the rotor coupler are operably coupled, wherein the archery crossbow is operable to launch a projectile in a forward direction, and wherein the rotor coupler is configured to position the rotor so that the rotor is located forward of an end of the crossbow limb of the archery crossbow when the crossbow is in a cocked position.

18. The rotor support system of claim 17, wherein:

the archery crossbow is configured to be aimed forward toward a target;

the rotor is rototable about a first axis;

the limb coupler is rototable about a second axis; and the rotor coupler is configured to maintain the first axis forward of the second axis in uncocked and cocked conditions of the archery crossbow.

19. The rotor support system of claim 17, wherein:

the crossbow limb comprises a first crossbow limb;

the end of the crossbow limb comprises a first limb end;

the archery crossbow comprises a second crossbow limb;

the second crossbow limb comprises a second limb end;

a vertical plane extends between the first and second limb ends;

the vertical plane intersects with a longitudinal axis of the archery crossbow when the archery crossbow is horizontally oriented and aimed toward a target;

the rotor is rototable about a first axis;

the limb coupler is rototable about a second axis; and the first and second axes are positioned forward of the vertical plane when the archery crossbow is in uncocked and cocked conditions.

20. A rotor support system comprising:

a limb coupler configured to be moveably coupled to a crossbow limb of an archery crossbow so as to enable a first movement of the limb coupler relative to the crossbow limb; and a rotor coupler configured to be moveably coupled to a rotor of the archery crossbow so as to enable a second movement of the rotor relative to the rotor coupler, wherein the limb coupler and the rotor coupler are operably coupled, and wherein the limb of the crossbow comprises a set of limb segments, and the limb coupler comprises a limb interface configured to fit at least partially between the limb segments.

21. The rotor support system of claim 20, wherein:

the archery crossbow is configured to be aimed forward toward a target;

the rotor is rototable about a first axis;

the limb coupler is rototable about a second axis; and the rotor coupler is configured to maintain the first axis forward of the second axis in uncocked and cocked conditions of the archery crossbow.

22. The rotor support system of claim 20, wherein:

the crossbow limb comprises a first limb end;

the archery crossbow comprises a second crossbow limb;

the second crossbow limb comprises a second limb end;

a vertical plane extends between the first and second limb ends;

the vertical plane intersects with a longitudinal axis of the archery crossbow when the archery crossbow is horizontally oriented and aimed toward a target;

the rotor is rototable about a first axis;

the limb coupler is rototable about a second axis; and the first and second axes are positioned forward of the vertical plane when the archery crossbow is in uncocked and cocked conditions.

23. A rotor support system comprising:

a limb coupler configured to be moveably coupled to a crossbow limb of an archery crossbow so as to enable a first movement of the limb coupler relative to the crossbow limb; and a rotor coupler configured to be moveably coupled to a rotor of the archery crossbow so as to enable a second movement of the rotor relative to the rotor coupler, wherein the limb coupler and the rotor coupler are operably coupled, wherein the crossbow limb defines a limb cavity located on a first axis, and the limb coupler comprises a limb coupler cavity located on the first axis when the limb coupler is coupled to the limb, and the rotor support system further comprises a first axle configured to couple the limb coupler to the limb, and wherein the first axle extends along the first axis, is at least partially inserted into the limb cavity, and is at least partially inserted into the limb coupler cavity.

24. The rotor support system of claim 23, wherein:

the archery crossbow is configured to be aimed forward toward a target;

the rotor is rototable about a first axis;

the limb coupler is rototable about a second axis; and the rotor coupler is configured to maintain the first axis forward of the second axis in uncocked and cocked conditions of the archery crossbow.

25. The rotor support system of claim 23, wherein:

the crossbow limb comprises a first limb end;

the archery crossbow comprises a second crossbow limb;

the second crossbow limb comprises a second limb end;

a vertical plane extends between the first and second limb ends;

the vertical plane intersects with a longitudinal axis of the archery crossbow when the archery crossbow is horizontally oriented and aimed toward a target;

the limb coupler is rototable about the first axis;

the rotor is rototable about a second axis; and the first and second axes are positioned forward of the vertical plane when the archery crossbow is in uncocked and cocked conditions.

26. A method for manufacturing a rotor support system, the method comprising:

structuring a limb coupler so that the limb coupler is configured to be moveably coupled to a crossbow limb of an archery crossbow so as to enable a first movement of the limb coupler relative to the crossbow limb;

structuring a rotor coupler so that the rotor coupler is configured to be moveably coupled to a rotor of the archery crossbow so as to enable a second movement of the rotor relative to the rotor coupler; and structuring the limb coupler and the rotor coupler to be operably coupled, wherein the structuring of the limb coupler comprises configuring the limb coupler to be rotatably coupled to the crossbow limb of the archery crossbow.

27. The method of claim 26, wherein the structuring of the limb coupler and the rotor coupler enable the first movement to occur independent of the second movement.

28. The method of claim 26, wherein: (a) the archery crossbow is configured to be aimed forward toward a target; and (b) the rotor is rotatable about a first axis, the method comprising:

structuring the limb coupler so as to rotate about a second axis; and structuring the rotor coupler so as to maintain the first axis forward of the second axis in uncocked and cocked conditions of the archery crossbow.

29. The method of claim 26, wherein: (a) the crossbow limb comprises a first limb end; (b) the archery crossbow comprises a second crossbow limb; (c) the second crossbow limb comprises a second limb end; (d) a vertical plane extends between the first and second limb ends; and (e) the vertical plane intersects with a longitudinal axis of the archery crossbow when the archery crossbow is horizontally oriented and aimed toward a target, the method comprising:

structuring the rotor to rotate about a first axis;

structuring the limb coupler to rotate about a second axis; and structuring the rotor coupler and the limb coupler so as to position the first and second axes forward of the vertical plane when the archery crossbow is in uncocked and cocked conditions.

* * * * *